US007530565B2

(12) United States Patent
Terao et al.

(10) Patent No.: US 7,530,565 B2
(45) Date of Patent: May 12, 2009

(54) METHOD AND APPARATUS FOR PROCESSING PRINTED SHEETS INCORPORATED REFERENCE

(75) Inventors: Yasunobu Terao, Izunokuni (JP); Mikio Yamamoto, Izunokuni (JP); Tomomi Iijima, Mishima (JP); Takahiro Kawaguchi, Mishima (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/531,783

(22) Filed: Sep. 14, 2006

(65) Prior Publication Data

US 2007/0057435 A1 Mar. 15, 2007

(30) Foreign Application Priority Data

Sep. 15, 2005 (JP) ..... 2005-268881
Sep. 16, 2005 (JP) ..... 2005-270512

(51) Int. Cl.
*B65H 31/00* (2006.01)

(52) U.S. Cl. ..... 271/207; 271/220

(58) Field of Classification Search ..... 271/207, 271/221

See application file for complete search history.

(56) References Cited

U.S. PATENT DOCUMENTS 6,942,206 B2 * 9/2005 Kuwata et al. ..... 270/58.08
6,951,334 B2 * 10/2005 Saito ..... 271/207
6,986,510 B2 * 1/2006 Saito et al. ..... 271/220
6,997,456 B2 * 2/2006 Fukatsu et al. ..... 271/306
7,134,659 B2 * 11/2006 Sato et al. ..... 271/265.01
7,281,708 B2 * 10/2007 Murata et al. ..... 270/58.12
2004/0201165 A1 * 10/2004 Kamiya et al. ..... 271/220
2006/0071410 A1 * 4/2006 Koie ..... 271/207
2007/0029723 A1 * 2/2007 Sato ..... 271/207
2007/0057442 A1 * 3/2007 Terao et al. ..... 271/207
2007/0069453 A1 * 3/2007 Thomas et al. ..... 271/207

FOREIGN PATENT DOCUMENTS

JP 6-99070 12/1994
JP 2000-219400 8/2000
JP 2004-345748 12/2004

* cited by examiner

*Primary Examiner*—Kaitlin S Joerger
(74) *Attorney, Agent, or Firm*—Amin, Turocy & Calvin, LLP

(57) ABSTRACT

An apparatus for processing printed sheets includes a processing tray and a standby tray having a pair of tray members that are movable in a width direction of sheets. The tray members are movable between a first position where a sheet is placed on the tray members and a second position where the sheet is dropped from the tray members. A roller mechanism for feeding the sheet onto the standby tray, a paddle mechanism, and an assist arm are arranged near a rear end of the standby tray. As the tray member moves from the first position to the second position, the paddle mechanism strikes a rear end of the sheet downward. The assist arm is placed near the roller mechanism to inhibit the rear end of the sheet from floating from the standby tray while the tray member is moving from the first position to the second position.

13 Claims, 20 Drawing Sheets

METHOD AND APPARATUS FOR PROCESSING PRINTED SHEETS INCORPORATED REFERENCE

CROSS-REFERENCE TO RELATED APPLICATIONS

This application is based upon and claims the benefit of priority from prior Japanese Patent Applications No. 2005-268881, filed Sep. 15, 2005; and No. 2005-270512, filed Sep. 16, 2005, the entire contents of both of which are incorporated herein by reference.

BACKGROUND OF THE INVENTION

1. Field of the Invention

The present invention relates to an apparatus for processing printed sheets, for example, a finisher, which is connected to an image forming apparatus, as well as a method for processing printed sheets.

2. Description of the Related Art

A printed sheet processing apparatus such as a finisher is known which staples a pile of sheets (for example, copy sheets) printed by an image forming apparatus such as a digital copier. This printed sheet processing apparatus comprises a first sheet conveying path, a second sheet conveying path, and a processing tray on which sheets are stapled. The second sheet conveying path is longer than the first one.

For example, Jpn. Pat. Appln. KOKOKU Publication No. 6-99070 describes a printed sheet processing apparatus which, if any sheets are being stapled on a processing tray, guides a succeeding different sheet to the second conveying path to delay the arrival of this sheet. This structure absorbs the difference in processing speed between the image forming apparatus and the stapler.

This conventional printed sheet processing apparatus disadvantageously has the longer conveying path and is thus large. Further, the conventional printed sheet processing apparatus disadvantageously has the plurality of conveying paths and thus a complicated structure.

To eliminate these disadvantages, an apparatus has been proposed in which a standby tray divided into two widthwise pieces is placed above the processing tray. This apparatus stacks succeeding sheets delivered during a staple process, on the standby tray, and discharges a stapled pile of sheets from the processing tray to a discharge tray. The standby tray is subsequently opened and a paddle is used to strike the sheets on the standby tray downward. The sheets are thus forcibly dropped onto the processing tray.

However, depending on sheet type (sheet size or thickness) or print pattern, the sheets on the standby tray may be deformed, for example, warped or curled, and may thus be inappropriately placed on the standby tray. Accordingly, it is sometimes difficult to stably drop the sheets simply by opening the tray member and using the paddle to strike the sheets. This problem must be solved.

BRIEF SUMMARY OF THE INVENTION

An object of the present invention is to provide a method and apparatus for processing printed sheets which use a shorter conveying path to reduce the size of the apparatus.

An apparatus for processing printed sheets according to the present invention comprises:

a processing tray on which the sheets are aligned with one another in a width direction and a longitudinal direction to form a pile of sheets;

a standby tray having a pair of tray members arranged away a from each other in the width direction above the processing tray, the tray members being movable in the width direction, the tray members moving between a first position at which a sheet is placed on the tray members and a second position at which the sheet on the tray members is dropped onto the processing tray;

a tray driving mechanism which moves the pair of tray members between the first and second positions in synchronism with each other, a roller mechanism placed near a rear end of the standby tray to feed the sheets from an image forming apparatus onto the standby tray;

an assist arm which is movable in a vertical direction around an arm shaft placed near the roller mechanism, the assist arm rising in contact with the sheet being fed from the roller mechanism onto the standby tray, lowering when the sheet has been fed onto the standby tray, and pressing a rear end of the sheet toward the processing tray when the tray members move from the first position to the second position.

According to the present invention, the standby tray enables a shorter sheet conveying path to be configured to reduce the size of the apparatus. The assist arm further inhibits the sheets on the standby tray from being warped or deformed. This allows the sheets to be appropriately placed on the standby tray. The sheets can maintain a stable posture when dropped from the standby tray onto the processing tray.

Objects and advantages of the invention will be set forth in the description, which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description of the embodiments given below, serve to explain the principles of the invention.

DETAILED DESCRIPTION OF THE INVENTION

A first embodiment of the present invention will be described below in detail with reference to FIGS. 1 to 10.

Figure 1:
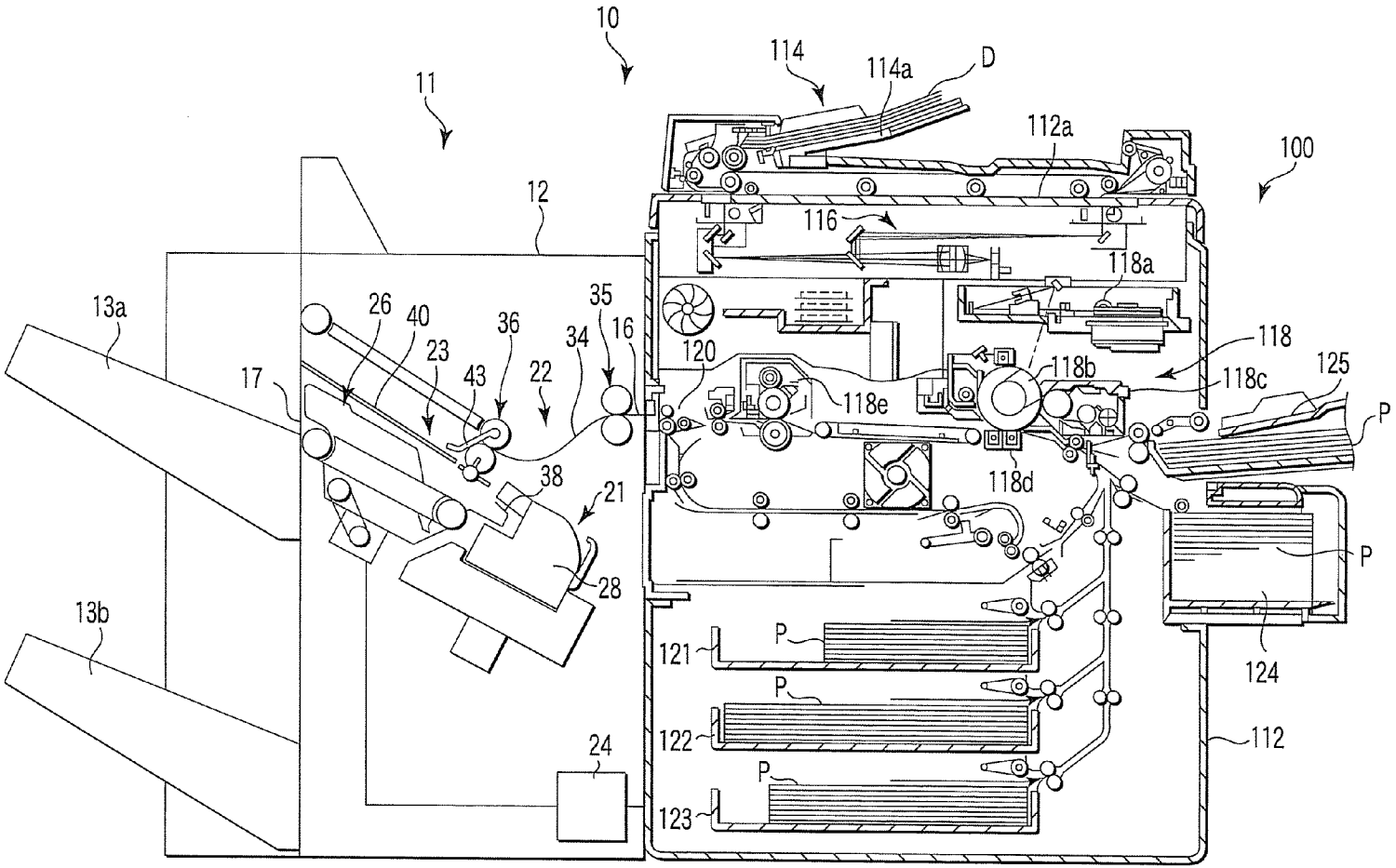
FIG. 1 is a sectional view showing an apparatus for processing printed sheets and an image forming apparatus according to a first embodiment of the present invention.

FIG. 1 shows a schematic diagram of a multi-function peripheral (hereinafter simply referred to as an MFP) 10. The MFP consists of a printed sheet processing apparatus 11 according to an embodiment of the present invention and a digital copier 100 to which the printed sheet processing apparatus 11 is connected. The digital copier 100 is an example of an image forming apparatus according to the present invention.

The digital copier 100 has a housing 112 constituting a jacket of the apparatus and a original receiving glass 112*a* consisting of a transparent glass plate, on a top surface of the housing 112. An automatic original feeder 114 (hereinafter simply referred to as an ADF 114) is provided on the original receiving glass 112*a* so that it can be opened and closed. The ADF 114 automatically feeds a original D to a predetermined position on the original receiving glass 112*a*.

For example, the original D is set on a sheet feeding tray 114*a* of the ADF 114, and the following are set: whether or not to execute a staple process, how to execute the staple process, the number of sheets copied, and sheet size. A copy start switch is then operated. This allows each of the originals D on the sheet feeding tray 114*a* to be automatically fed to a original read position on the original receiving glass 112*a*. After being read, the original D is automatically discharged at an appropriate timing.

A scanner section 116, a printer section 118, cassettes 121, 122, and 123, and the like are disposed inside the housing 112; copy sheets P (hereinafter simply referred to as sheets P), an example of sheets, are housed in the cassettes 121, 122, and 123. A bulk feeder 124 and a manual tray 125 are attached to a right wall of the housing 112 in FIG. 1; a large number of sheets P of the same size are accommodated in the bulk feeder 124 and manual tray 125. A printed sheet processing apparatus 11 described below is connected to a left wall of the housing 112 in FIG. 1.

The scanner section 116 illuminates and scans the original D fed to the original read position on the original receiving glass 112*a* by the ADF 114. Reflected light is read and converted into electricity to acquire image information on the original D.

The printer section 118 actuates a laser device 118*a* on the basis of the image information read by the scanner section 116. An electrostatic latent image is thus formed on a peripheral surface of a photosensitive drum 118*b* on the basis of the image information. The printer section 118 supplies toner to the electrostatic latent image on the photosensitive drum 118*b* via a developing device 118*c* to develop the image. The toner image is transferred to the sheet P by a transfer charger 118*d*. At this time, the sheet P is fed from either the cassette 121, 122, or 123 or the bulk feeder 124 or the manual tray 125.

The printer section 118 further supplies the sheet P to which the toner image has been transferred, to a fixing device 118*e*. The toner image is heated, melted, and fixed to the sheet P, which is then discharged to the printed sheet processing apparatus 11 via a discharge port 120. The sheet P discharged via the discharge port 120 corresponds to a sheet according to the present invention.

The printed sheet processing apparatus 11 will be described below.

Figure 6:
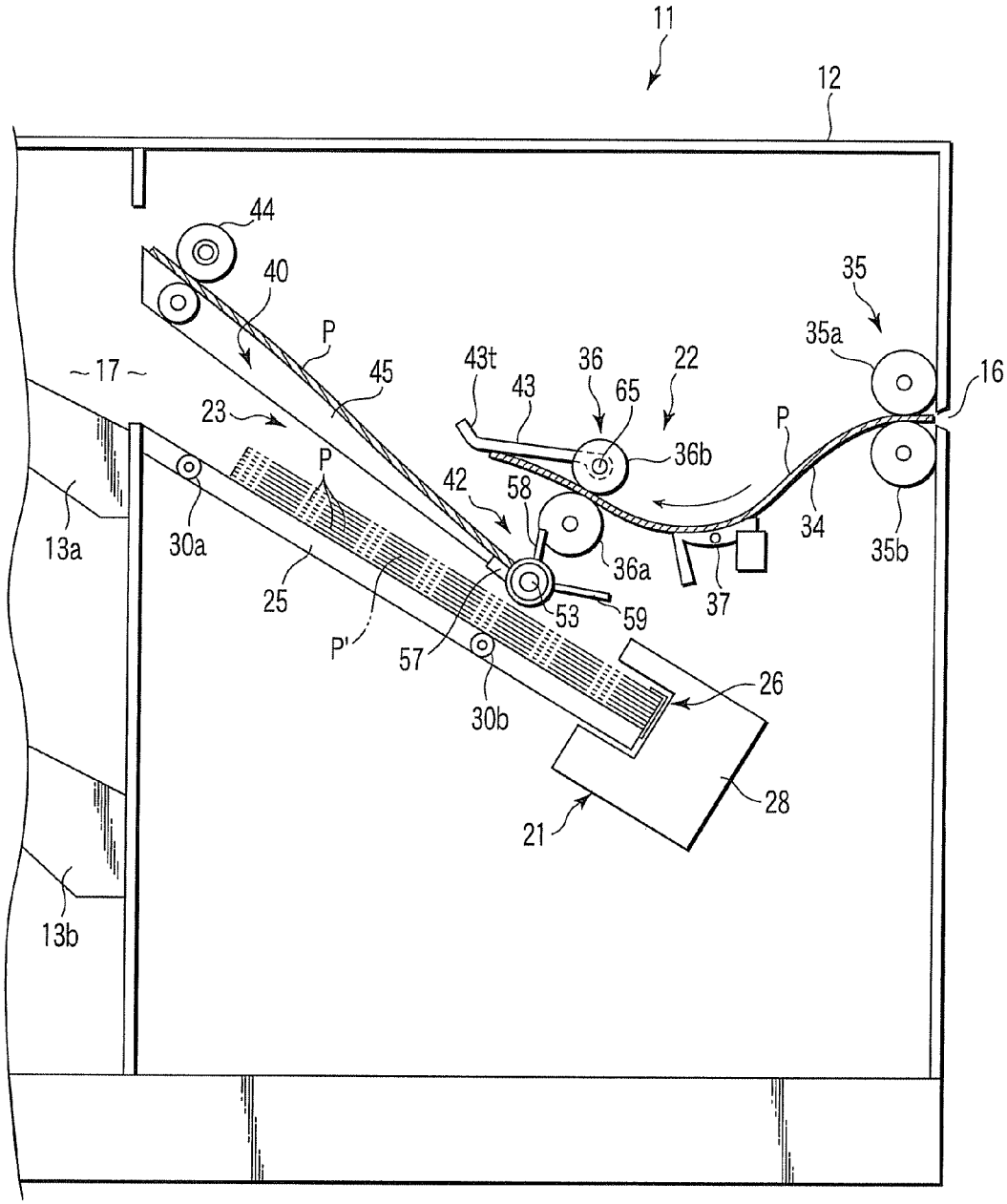
FIG. 6 is a sectional view showing that the second sheet is being supplied to a standby tray in the printed sheets processing apparatus shown in FIG. 2.

The printed sheet processing apparatus 11 is provided adjacent to a digital copier 100 that is an example of an image forming apparatus. The printed sheet processing apparatus 11 stacks and aligns an appropriate number of sheets P printed by the digital copier 100 and constituting an intended original. The sheets P are further post-processed, for example, stapled to form a pile of sheets P' (FIG. 6). The stapling process involves aligning a plurality of stacked sheets P with one another at one end and binding the aligned sheets.

Figure 2:
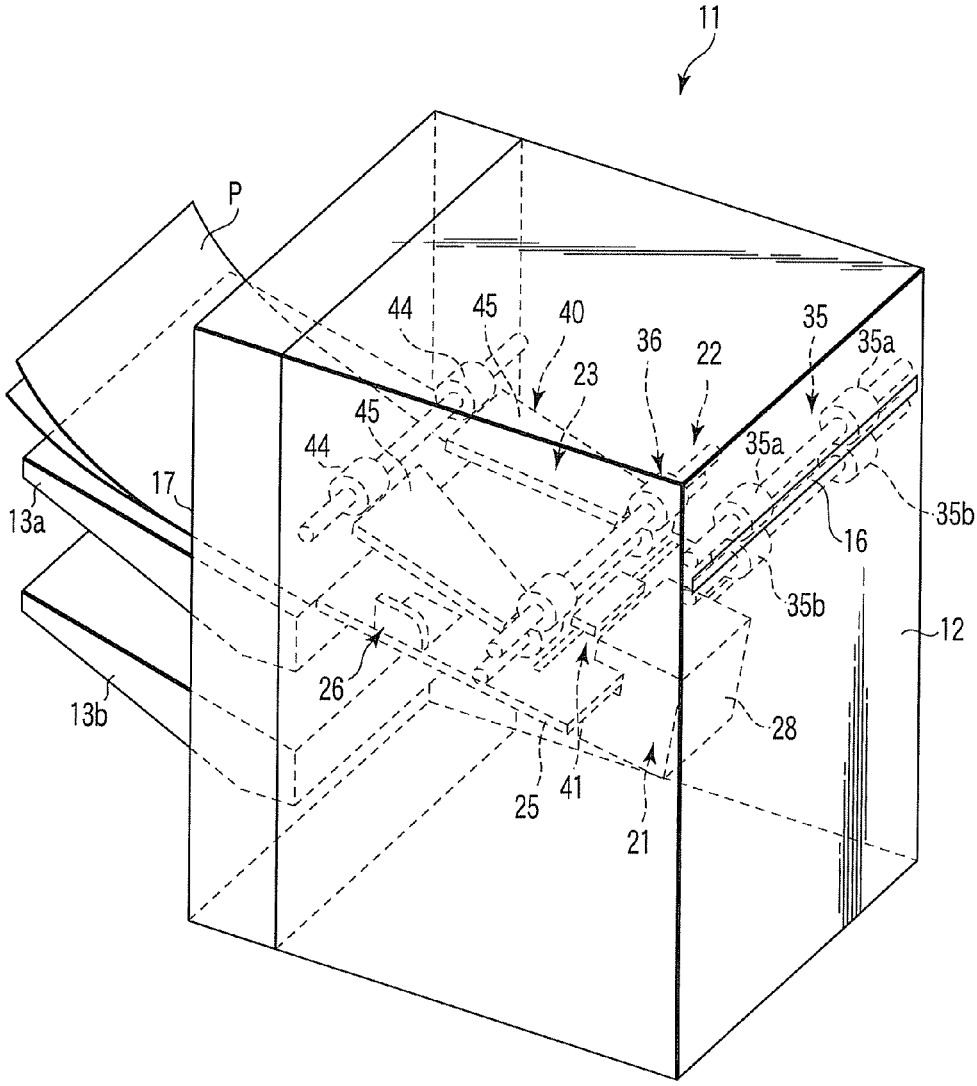
FIG. 2 is a perspective view of the printed sheet processing apparatus shown in FIG. 1.

As shown in FIGS. 2 and 6 and others, the printed sheet processing apparatus 11 comprises a housing 12, an upper sheet discharging tray 13*a* installed on the housing 12, and a lower sheet discharging tray 13*b* installed on the housing 12. Post-processed sheets P and a pile of sheets P' described below are held in the sheet discharging trays 13*a* and 13*b*. The housing 12 is provided with a supply port 16 that receives printed sheets P from the digital copier 100 and a discharge port 17 through which a pile of sheets P' of post-processed sheets is discharged.

The housing 12 contains, for example, post-processing section 21 for post-processing sheets P, conveying section for supplying the sheets P to the post-processing section 21, and active drop section 23 provided between the post-processing section 21 and the conveying section 22. The sections 21, 22, and 23 are controlled by control section 24 (FIG. 5) comprising a microprocessor, a memory, and the like and having a computer function.

As shown in FIGS. 2 and 6 and others, the post-processing section 21 includes a processing tray 25, an aligning mechanism 26, a stapler 28, and conveying rollers 30*a* and 30*b*. The processing tray 25 is inclined so that its rear end, that is, its side closer to the stapler 28, is lower. In other words, the processing tray 25 is placed so that its front portion faces obliquely upward.

The aligning mechanism 26 has a function for aligning a plurality of sheets P on the processing tray 25 with one another in a width direction and a longitudinal direction to form a pile of sheets P'. The aligning mechanism 26 aligns the sheets P on the processing tray 25 with one another in the width direction and the longitudinal direction orthogonal to the width direction. This results in forming a pile of sheets P' of a predetermined number of sheets P. The stapler 28 executes a staple process on the pile of sheets P' held on the processing tray 25 as required.

Belts (not shown) are wound around the conveying rollers 30*a* and 30*b* and can be rotated in synchronism with each other in the same direction by a motor (not shown). A discharging mechanism 38 (FIG. 8) is provided in a widthwise central portion of the processing tray 25 to convey the post-processed pile of sheets P' toward the sheet discharging tray 13*a*.

As shown in FIGS. 2 and 6 and others, the conveying section 22 comprises a conveying path 34 for sheets P, an inlet roller pair 35 placed near the supply port 16, located on the upstream side of the conveying path 34, and an outlet roller pair 36 located on the downstream side of the conveying path 34. The outlet roller pair 36 is an example of a roller mechanism according to the present invention.

The inlet roller pair 35 includes an upper roller 35*a* and a lower roller 35*b*. The outlet roller pair 36, an example of the roller mechanism, includes a lower conveying roller 36*a* and an upper pinch roller 36*b*. A sensor 37 is provided in the middle of the conveying path 34 to detect the end of a sheet P.

As shown in FIGS. 2 to 6, the active drop section 23 comprises a standby tray 40 placed above the processing tray 25, a tray driving mechanism 41 (FIG. 4), a paddle mechanism 42, an assist arm 43, and a roller member 44 positioned in front of the standby tray 40.

The standby tray 40 is divided into a pair of tray members 45 in the width direction (width direction of sheets P). The tray members 45 are arranged away from and opposite each other above the processing tray 25. The tray members 45 can be moved by tray driving mechanism 41 in synchronism with each other in the opposite directions in the width direction of the processing tray 25.

Figure 4:
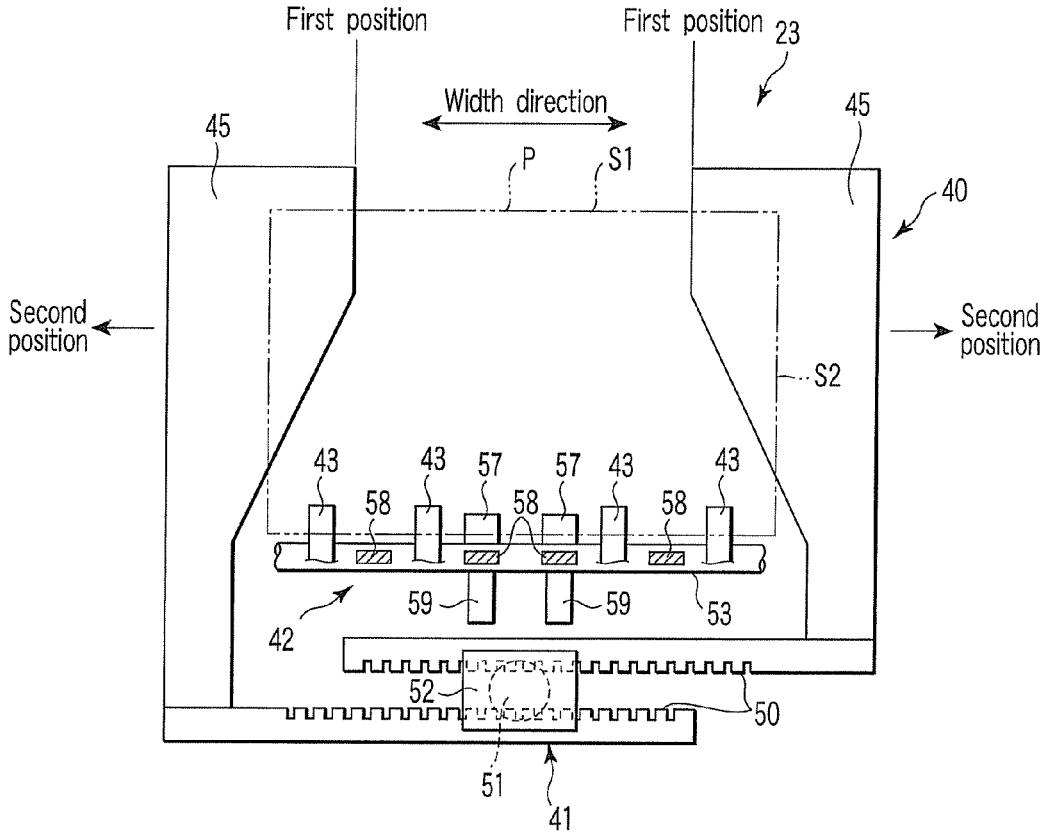
FIG. 4 is a plan view schematically showing the active drop section of the printed sheet processing apparatus shown in FIG. 2.

The tray driving mechanism 41 has a function for moving the pair of tray members 45 in synchronism with each other in the width direction of sheets P. The pair of tray members 45 can move between a first position (called a closed position) where sheets P are placed on the standby tray 40 and a second position (called an open position) where the sheets P on the standby tray 40 are dropped onto the processing tray 25. As shown in FIG. 4, the tray driving mechanism 41 comprises a rack 50 provided at a rear end of the tray member 45, a pinion gear 51 that drives the rack 50, and a motor 52 that rotates the pinion gear 51.

As shown in FIGS. 4 and 6, the paddle mechanism 42 comprises a first shaft (paddle shaft) 53, a sheet receiving member 57 that rotates together with the first shaft 53, a short rubber paddle 58, and a long rubber paddle 59. The first shaft 53 is provided between the processing tray 25 and the outlet roller pair 36. That is, the first shaft 53 is placed near the roller pair 36 above the processing tray 25.

The short paddle 58 corresponds to a paddle member according to the present invention. The sheet receiving member 57, short paddle 58, and long paddle 59 are all attached to the first shaft 53. As shown in FIG. 4, the rear end of a sheet P sits on the sheet receiving member 57. The sheet P is, for example, A4-sized and has a pair of parallel long sides S1 and a pair of short sides S2 perpendicular to the long sides S1.

Figure 9:
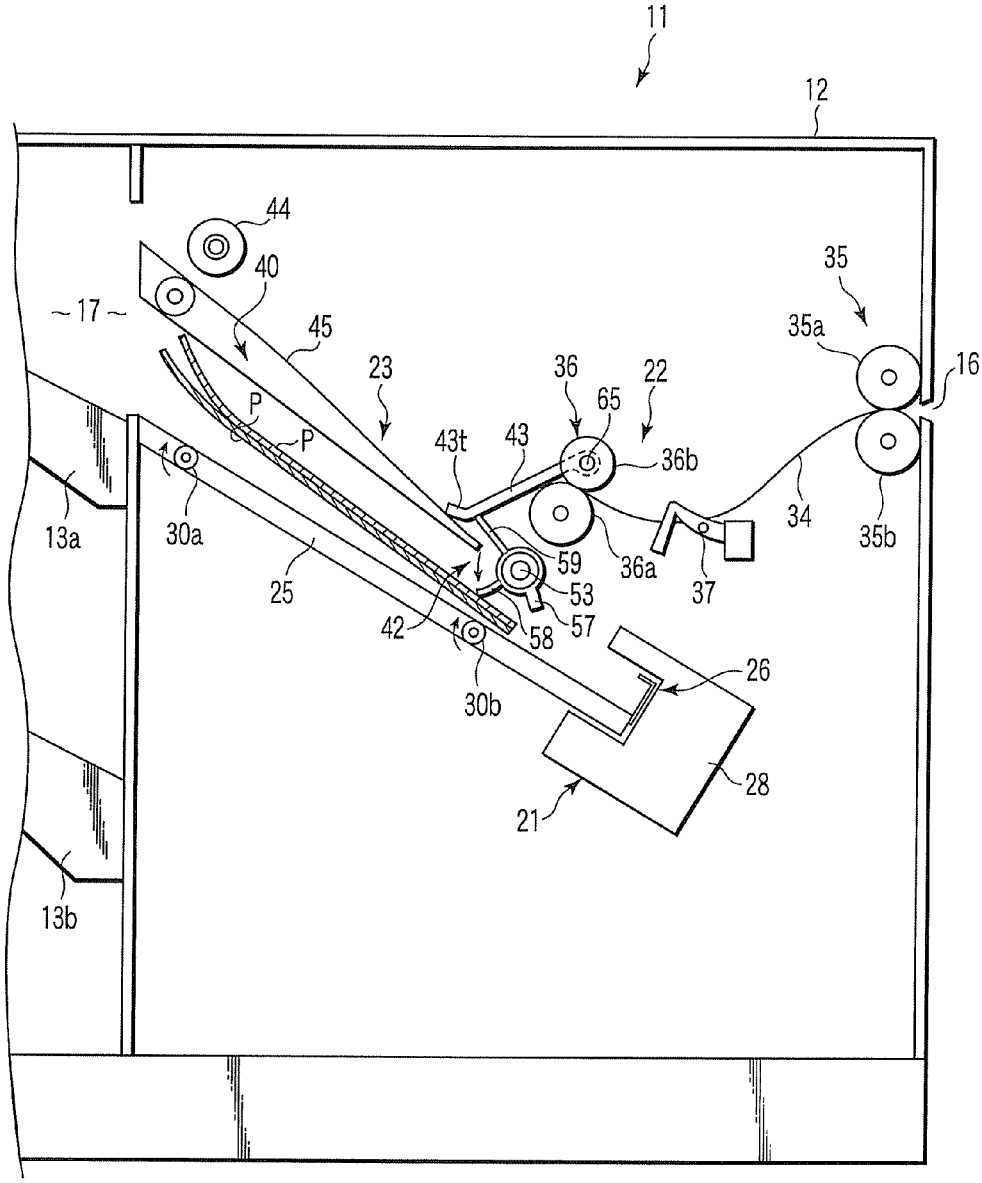
FIG. 9 is a sectional view showing that sheets are dropped from the standby tray onto a processing tray in the printed sheets processing apparatus shown in FIG. 2.
Figure 10:
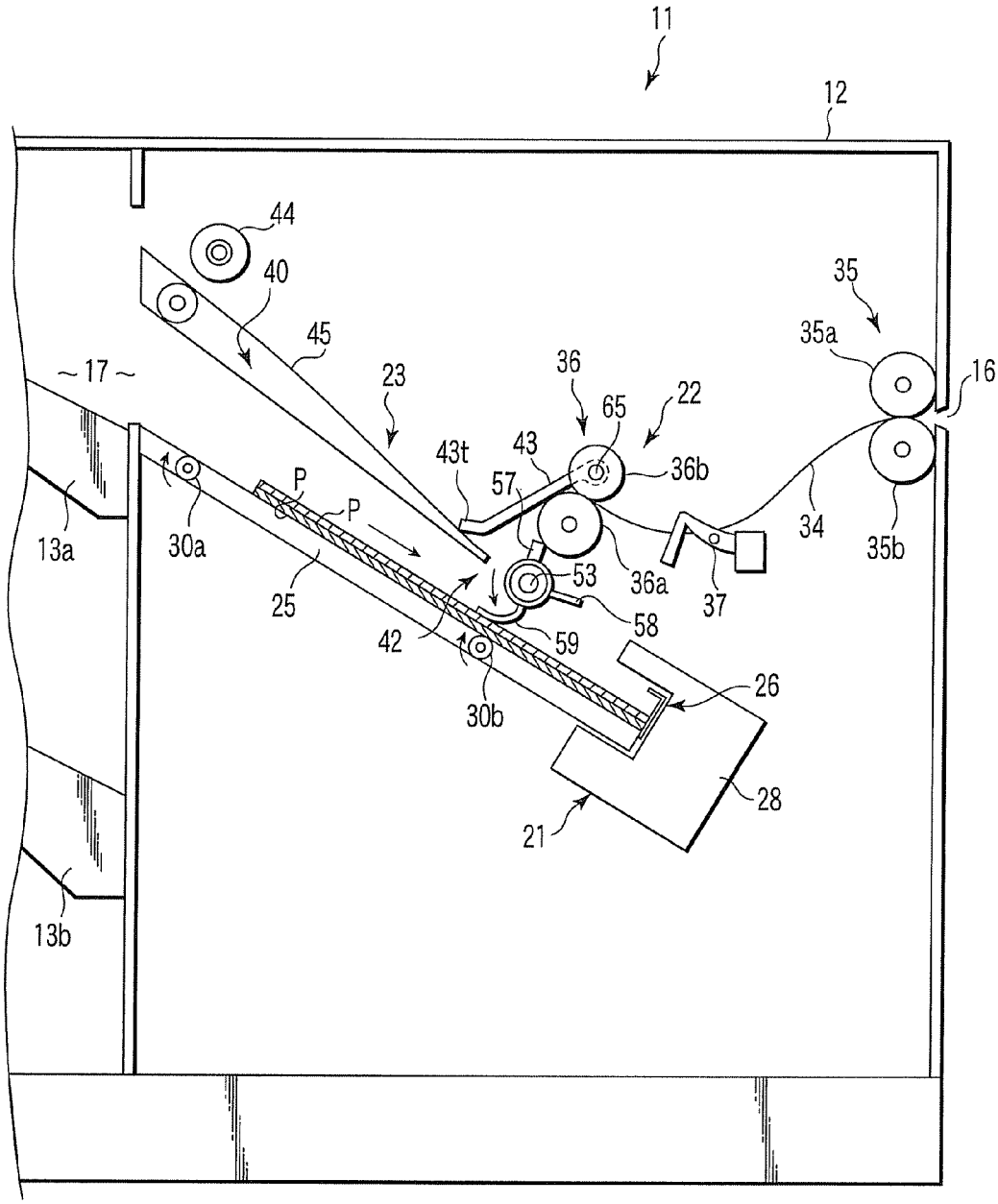
FIG. 10 is a sectional view showing that the sheets have been fed on the processing tray in the printed sheets processing apparatus shown in FIG. 2.

As the tray members 45 of the standby tray 40 move from the first (closed) position to the second (open) position, the short paddle 58 rotates together with the first shaft 53 to strike the rear ends of the sheets P downward as shown in FIG. 9. The long paddle 59 has a function for rubbing the sheets P on the processing tray 25 toward the stapler 28 as shown in FIG. 10.

Figure 3:
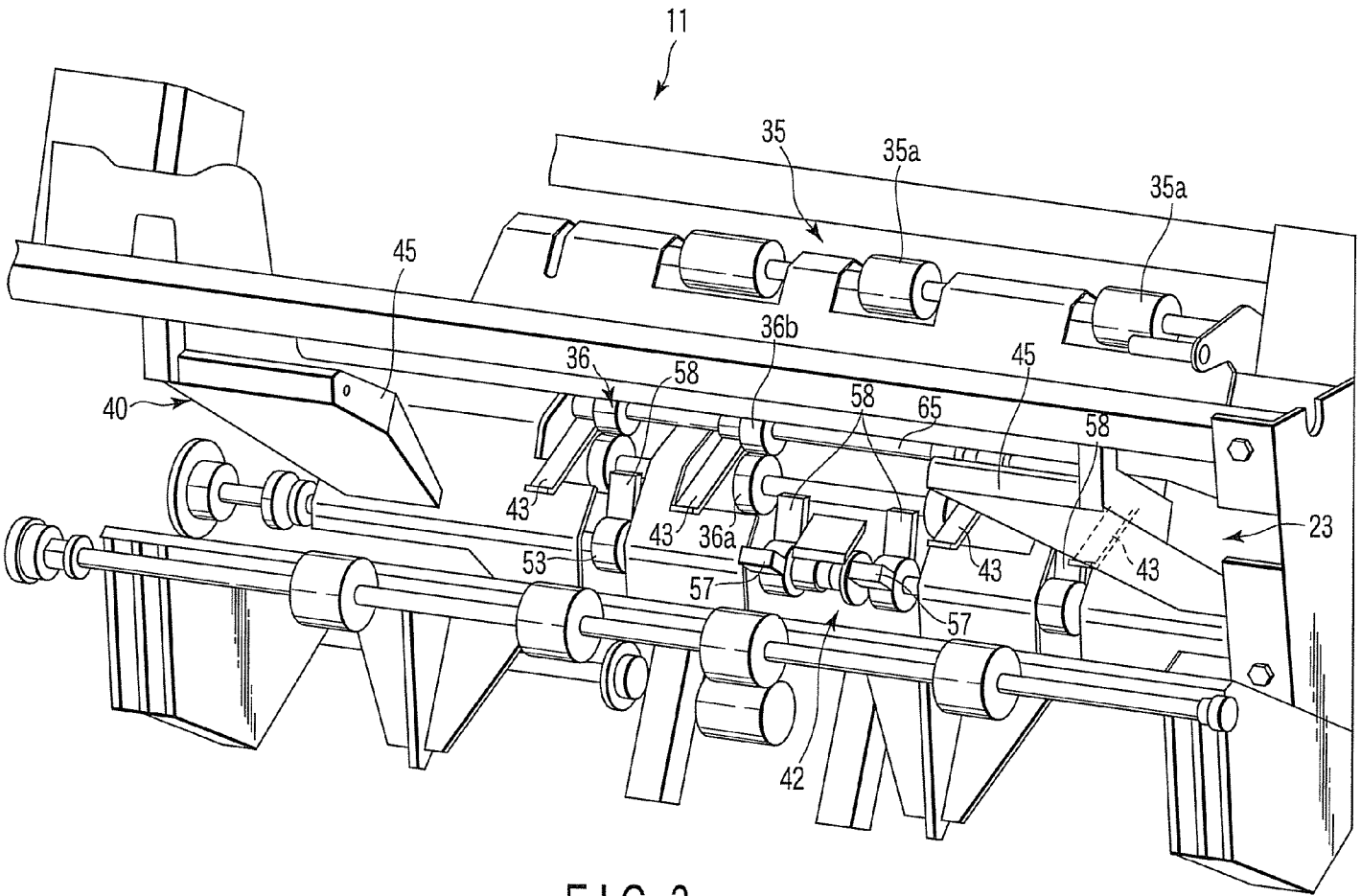
FIG. 3 is a perspective view of vicinity of active drop section of the printed sheet processing apparatus shown in FIG. 2.

As shown in FIGS. 3, 4, and 6, for example, four assist arms 43 are arranged on a second arm (arm shaft) 65 in its axial direction. The assist arms 43 are movable around the second shaft 65 in the vertical direction. In a free state with no external forces, the weight of the assist arms 43 causes the tips 43*t* of the assist arms 43 to hang obliquely forward toward the processing tray 25.

When a sheet P is fed from the outlet roller pair 36 onto the standby tray 40, the assist arms 43 move upward around the shaft 65 in contact with the sheet P. The number and positions of the assist arms 43 are selected as required. For example, one wide assist arm may be used which extends in the axial direction of the second shaft 65. Alternatively, two or more narrow assist arms may be provided on the second shaft 65 in its axial direction.

After the sheet P is fed from the outlet roller pair 36 onto the standby tray 40, the assist arms 43 move downward around the second shaft 65 in contact with the sheet P owing to their weight. This inhibits the sheets P on the standby tray 40 from being warped or curled. The assist arms 43 further have a function for inhibiting the rear ends of the sheets P from floating upward from the standby tray 40 as the tray member 45 moves from the first position to the second position.

The assist arms 43 also have a function for guiding the sheet P fed from the outlet roller pair 36 onto the standby tray 40 so that the sheet P moves along the standby tray 40 toward its front, that is, toward the roller member 44.

As shown in FIG. 6 and others, the second shaft (arm shaft) 65, the rotating center of the assist arms 43, is positioned on the same axis that contains the rotating center of pinch roller 36*b* of the outlet roller pair 36. In short, the rotating center of the assist arms 43 is located near the rotating center of the outlet roller pair 36, particularly of the pinch roller 36*b*.

The roller member 44 can be rotationally driven by a rotating mechanism (not shown) and moved in the vertical direction by an elevating and lowering mechanism. The roller member 44 is elevated by the elevating and lowering mechanism when a sheet P is fed from the outlet roller pair 36 onto the standby tray 40 (FIG. 7) or when a sheet P is dropped from the standby tray 40 onto the processing tray 25 (FIG. 9). To discharge a sheet P that need not be post-processed from the standby tray 40 to the discharge port 17 (sheet P that need not be dropped onto the processing tray 25), the rotating mechanism rotates the roller member 44 to convey the sheet P from the standby tray 40 to the discharge port 17.

Figure 5:
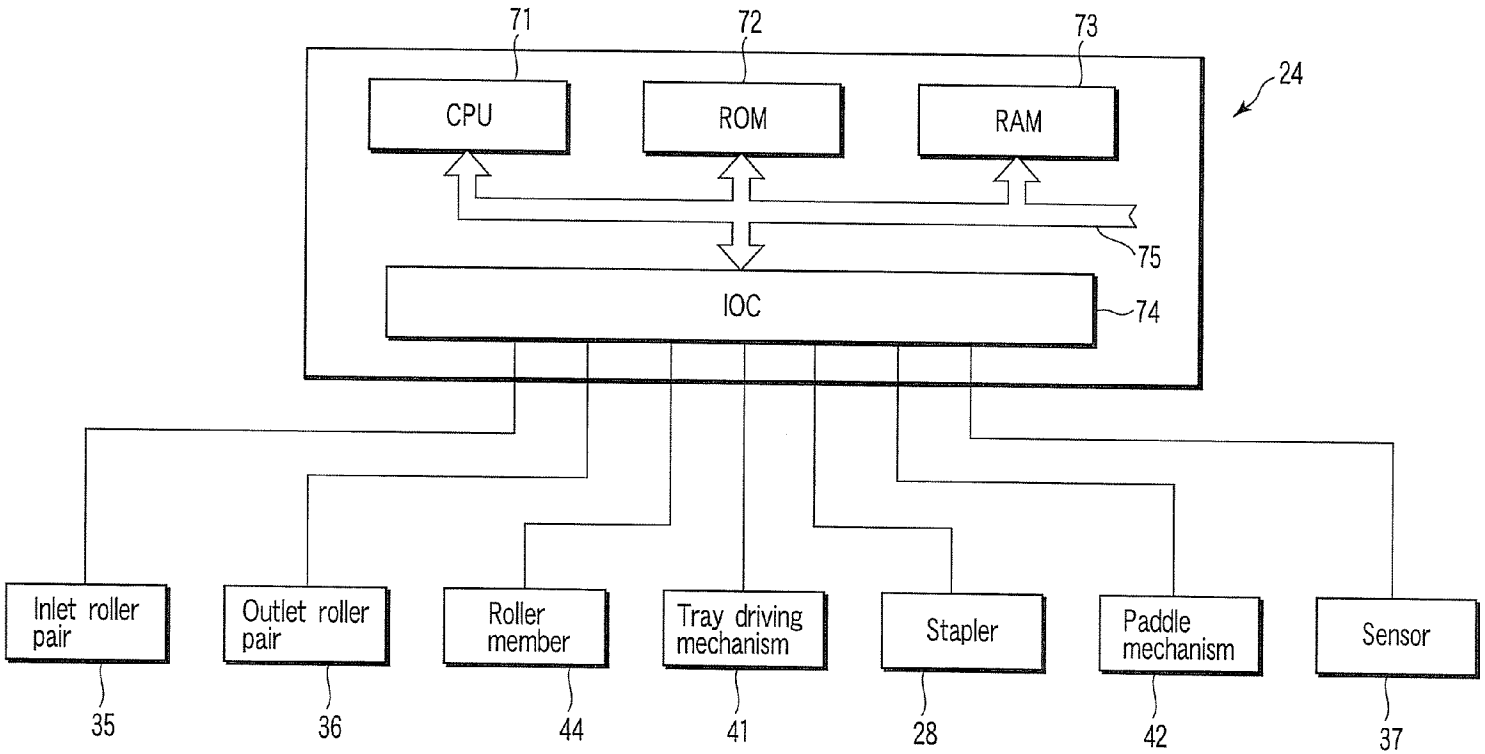
FIG. 5 is a block diagram showing control section of the printed sheets processing apparatus shown in FIG. 2.

The control section 24 shown in FIG. 5 comprises, for example, a CPU 71, ROM 72, RAM 73, input-output controller (IOC) 74, and an internal bus 75 that connects these components together. The IOC 74 is connected to, for example, the stapler 28, inlet roller pair 35, outlet roller pair 36, sensor 37, tray driving mechanism 41, paddle mechanism 42, and roller member 44 via a plurality of drivers (not shown). The following information is input to the control section 24: positional information on sheets P detected by the sensor 37 and the like, and the size and number of sheets P from the digital copier 100, the image forming apparatus.

The operation of the printed sheet processing apparatus 11 will be described below with reference to FIGS. 6 to 10.

FIG. 6 shows that the first sheet P sits on the standby tray 40, while the second sheet P is being supplied to the standby tray 40. The second sheet P moves on the conveying path 34 toward the outlet roller pair 36, while actuating the sensor 37, located in the middle of the conveying path 34. On this occasion, the tray members 45 of the standby tray 40 are in the first (closed) position to allow sheets P to be placed on the standby tray 40.

As shown in FIG. 4, the lateral pair of tray members 45 supports the opposite ends of a sheet P in its width direction. The sheet receiving member 57 of the paddle mechanism 42 supports the vicinity of widthwise center of rear end of the sheet P. As shown in FIG. 6, a predetermined number of sheets P already fed on the processing tray 25 are aligned with one another in the width direction and longitudinal direction by the aligning mechanism 26. A pile of sheets P' is thus formed.

Figure 7:
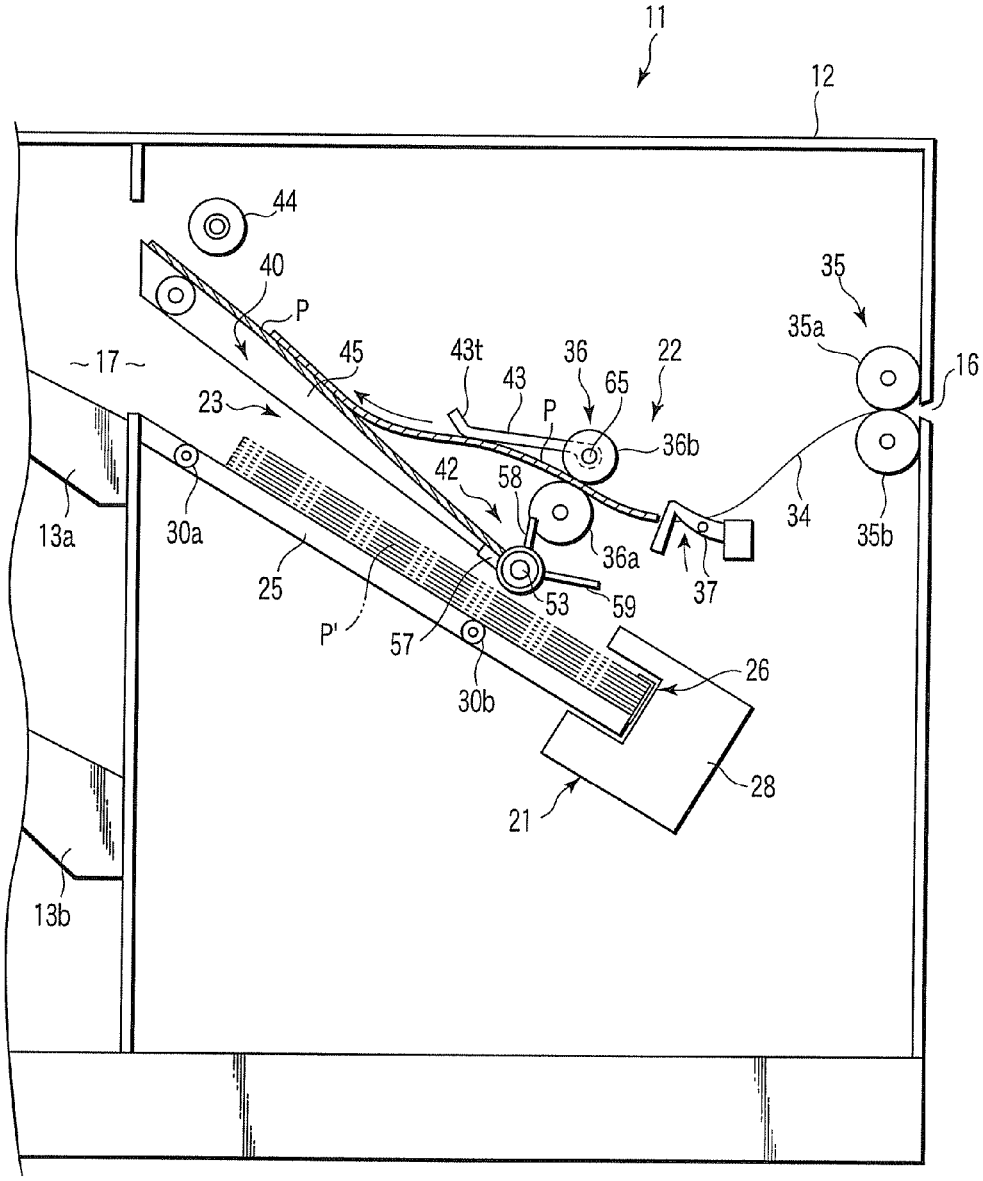
FIG. 7 is a sectional view showing that a rear end of the second sheet has passed by a sensor in the printed sheets processing apparatus shown in FIG. 2.

As shown in FIG. 7, the second sheet P is fed from the outlet roller pair 36 onto the standby array 40 while pushing up the assist arms 43. When the rear end of the sheet P passes by the sensor 37, the sensor 37 sends a signal indicating that the rear end of the sheet P has passed by, to the control section 24. A staple process is executed on the pile of sheets P' on the processing tray 25, which have been aligned together by the aligning mechanism 26.

Figure 8:
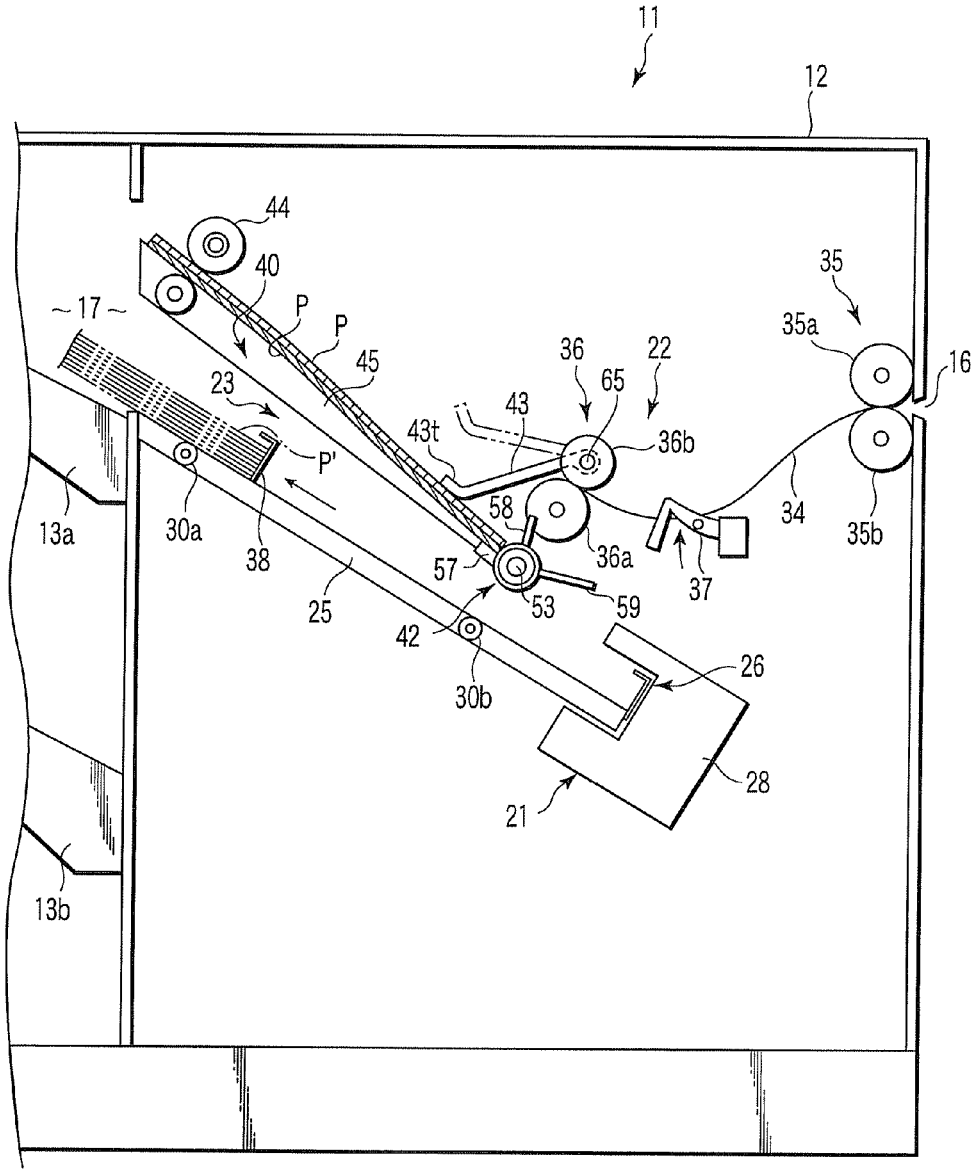
FIG. 8 is a sectional view showing that the second sheet has been supplied to the standby tray in the printed sheets processing apparatus shown in FIG. 2.

As shown in FIG. 8, with the two sheets P stacked on the standby tray 40, the assist arms 43 lower to the sheets P on the standby tray 40 owing to their weight. The assist arm 43 inhibits the rear of the sheets P from being curled or warped regardless of the type of the sheets P or the print pattern. While the two sheets P are being stacked on the standby tray 40, the preceding pile of sheets P' is conveyed to the sheet discharging tray 13*a* by the discharging mechanism 38.

The tray driving mechanism 41 (FIG. 4) is subsequently actuated to move the tray members 45 of the standby tray 40 from the first (closed) position to the second (open) position, and the paddle mechanism 42 is rotated. That is, as shown in FIG. 9, the sheet receiving member 57 rotates around the first shaft (paddle shaft) 53 to stop supporting the rear ends of the sheets P. The short paddle 58 and long paddle 59 also rotate in the same direction together with the sheet receiving member 57.

Thus, as shown in FIG. 9, the two sheets P fall from between the paired tray members 45 onto the processing tray 25 owing to their weight. At the same time, the short paddle 58 strikes the top surface of the rear ends of the sheets P to help drop the sheets P. The two sheets P are thus forcibly dropped onto the processing tray 25. When the sheets P fall from the standby tray 40, the assist arms 43 inhibit the sheets P from floating from the standby tray 40. This enables the sheets P to fall stably toward the processing tray 25.

As shown in FIG. 10, the sheets P having fallen onto the processing tray 25 are fed toward the stapler 28. The processing tray 25 is inclined so that its rear end (side closer to the stapler 28) is lower. Consequently, the sheets P having fallen onto the processing tray 25 have their rear ends slipped down toward the stapler 28. The lower sheet P on the processing tray 25 is conveyed toward the stapler 28 by rotation of the conveying rollers 30*a* and 30*b*. The upper sheet P on the processing tray 25 is urged to move toward the stapler 28 by a scraping operation of long paddle 59 of the paddle mechanism 42.

The two sheets P sit on the processing tray 25 as previously described. Subsequently, with the standby tray 40 kept in the second (closed) position, succeeding sheets P are sequentially fed from the outlet roller pair 36 to the processing tray 25. That is, the sheets P exiting the outlet roller pair 36 are guided to the processing tray 25 without sitting on the standby tray 40. These sheets P are sequentially stacked on the sheets P already placed on the processing tray 25. The aligning mechanism 26 also aligns the sheets P in the width direction and longitudinal direction to form a pile of sheets P' (FIG. 6).

As shown in FIG. 6, after a pile of sheets P' of a predetermined number of sheets P is formed on the processing tray 25, the stapler 28 executes a staple process as required. The pile of sheets P' is discharged through the discharge port 17 to the sheet discharging tray 13*a* by the discharging mechanism 38 as shown in FIG. 8.

As described above, while a post-process (for example, a staple process) is being executed on the pile of sheets P' on the processing tray 25, the two succeeding sheets P can be kept on the standby tray 40. That is, the arrival of the sheets P at the processing tray 25 can be delayed. This ensures the time required to post-process the pile of sheets P', enabling the post-process to be completed without any problems.

If the arrival of the sheets P at the processing tray 25 need not be delayed as in the case where the staple process is not executed, the standby tray 40 is set in the second (open) position when the first sheet P exits the outlet roller pair 36. This allows a sheet P exiting the outlet roller pair 36 to fall immediately onto the processing tray 25.

As described above, the present embodiment provides the standby tray 40 to enable a reduction in the length of the conveying path for sheets P. The size of the printed sheet processing apparatus 11 can thus be reduced. Moreover, the assist arms 43 ensure the safety of the sheets P on the standby tray 40.

That is, the assist arms 43 can inhibit the sheets P on the standby tray 40 from being warped or curled depending on the type (size or thickness) of sheets P or the print pattern. This allows the sheets P to be appropriately placed on the standby tray 40. Further, when the sheets P are dropped from the standby tray 40 onto the processing tray 25, the assist arms 43 can stabilize the posture of the sheets P. The assist arms 43 can be lowered to the sheets P on the standby tray 40 on the basis of their weight. This eliminates driving mechanisms and simplifies the configuration of the apparatus.

The assist arms 43 also provide a guide function for guiding the sheets P fed from the outlet roller pair 36 onto the standby tray 40, along the standby tray 40 toward the roller member 44. This advantageously eliminates dedicated guide mechanisms to reduce the number of parts required.

Now, with reference to FIGS. 11 to 22, description will be given of a printed sheet processing apparatus according to a second embodiment of the present invention. In the second embodiment, components common to the printed sheet processing apparatus according to the first embodiment are denoted by reference numerals common to the first embodiment.

Figure 11:
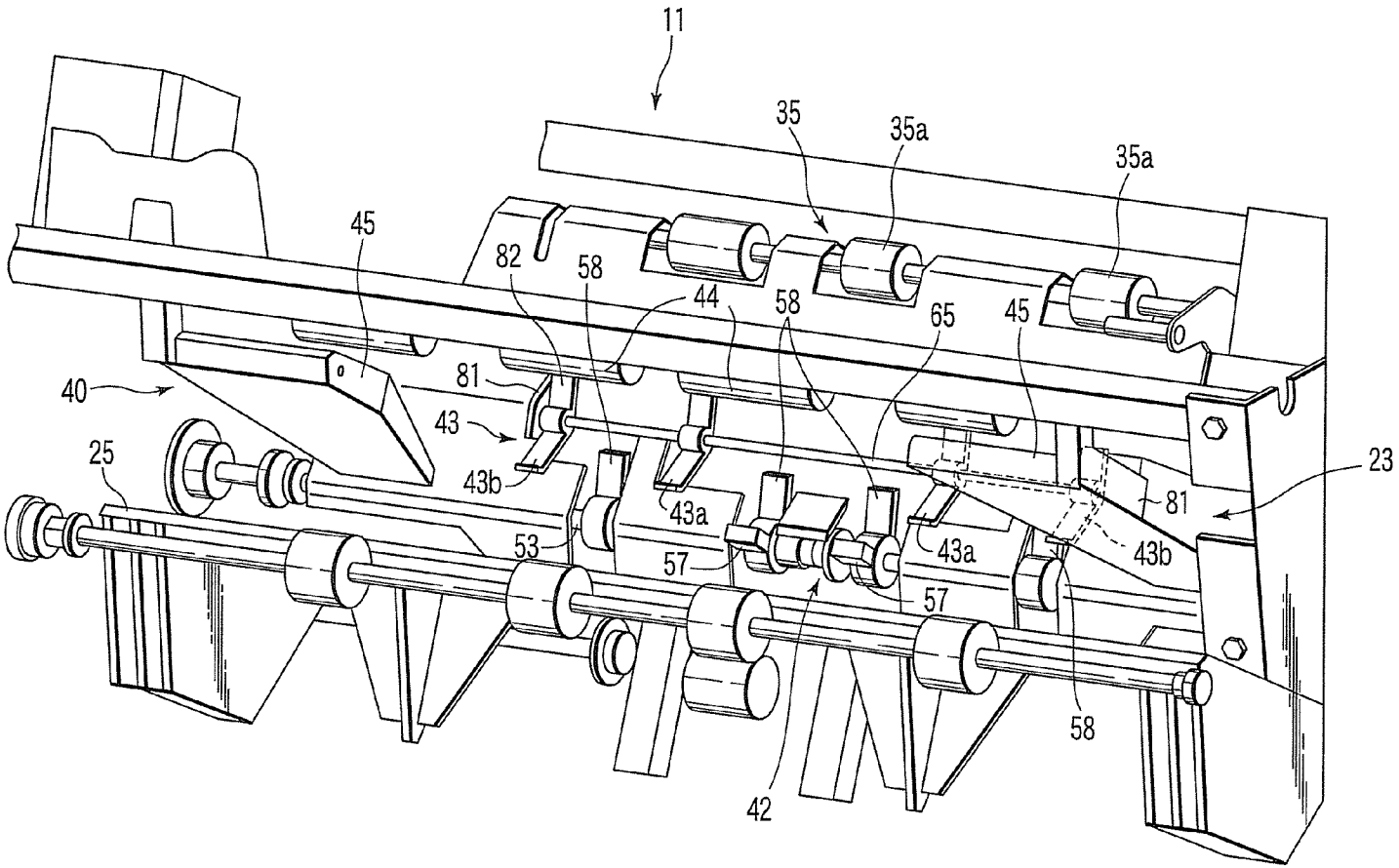
FIG. 11 is a perspective view of vicinity of active drop section of a printed sheet processing apparatus according to a second embodiment of the present invention.
Figure 12:
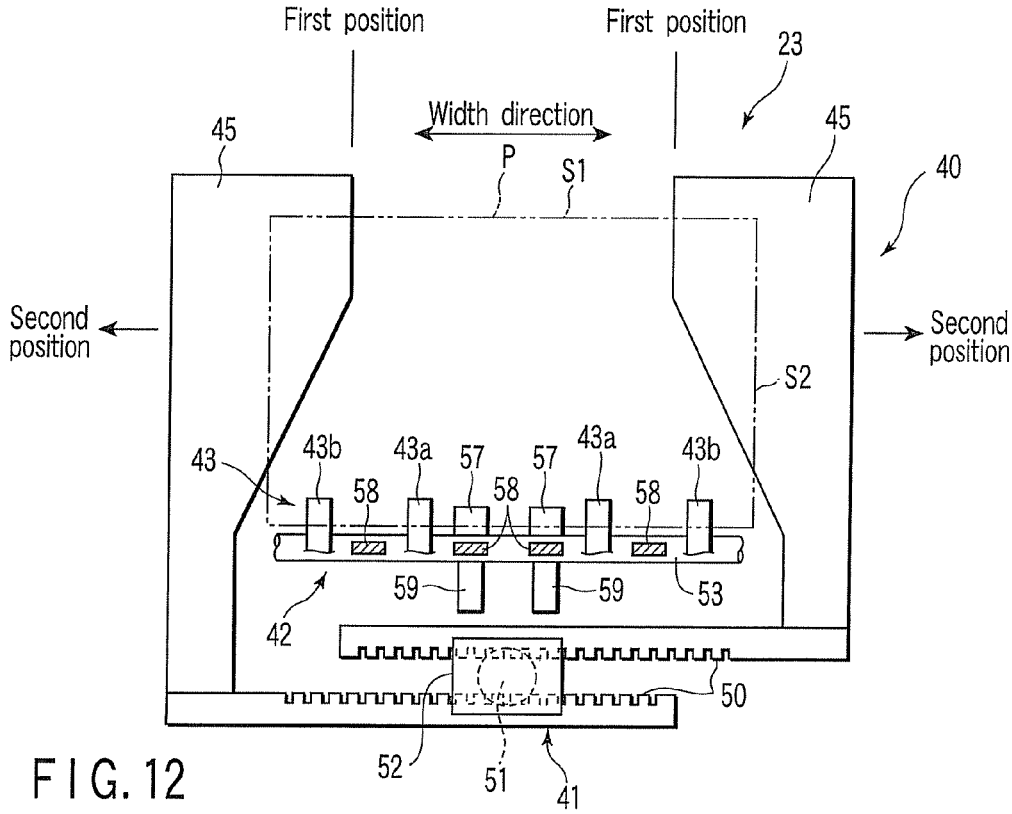
FIG. 12 is a plan view schematically showing the active drop section of the printed sheet processing apparatus shown in FIG. 11.
Figure 15:
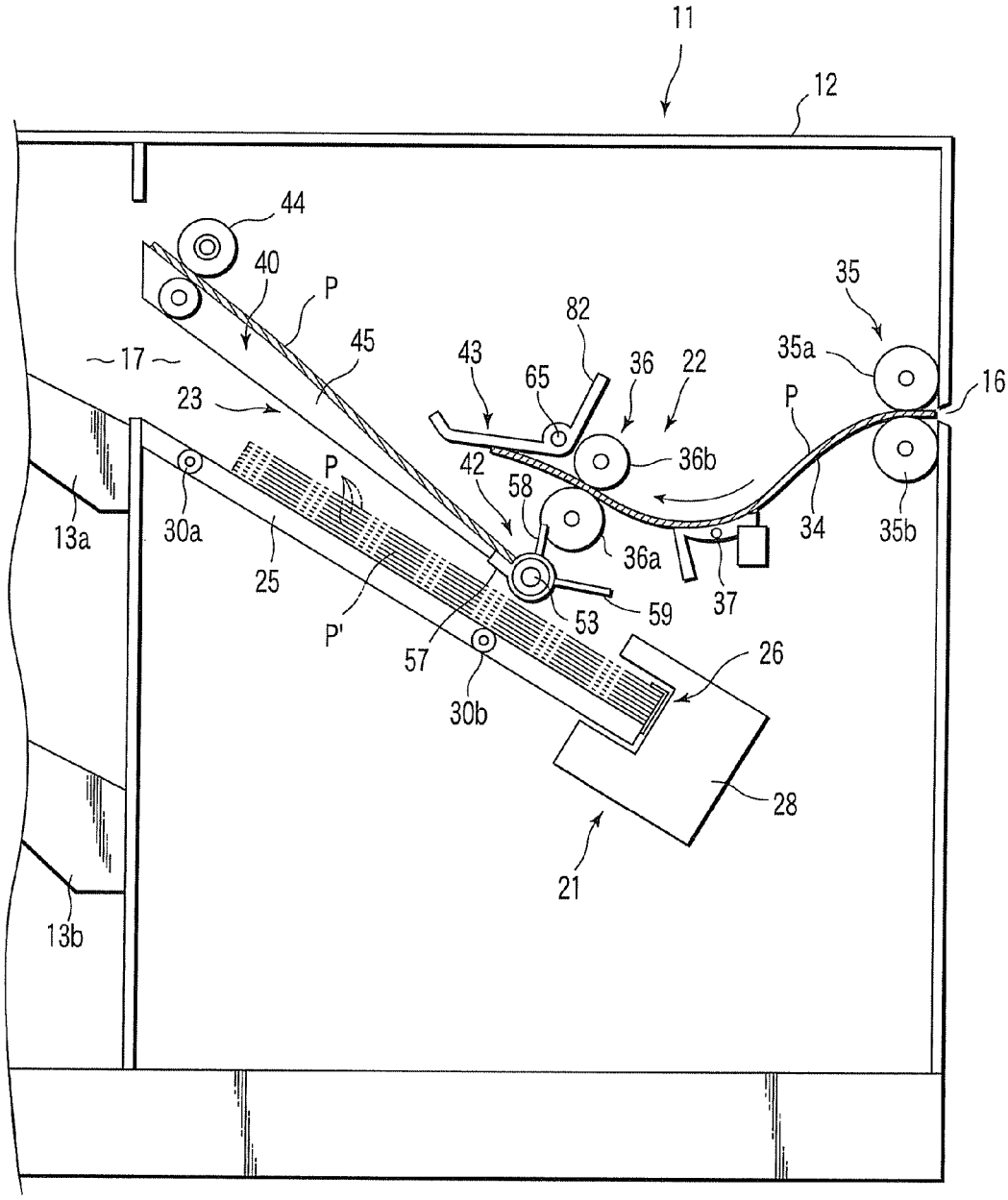
FIG. 15 is a sectional view showing that the second sheet is being supplied to a standby tray in the printed sheets processing apparatus shown in FIG. 11.

As shown in FIGS. 11, 12, and 15, the active drop section 23 comprises the standby tray 40 placed above the processing tray 25, the tray driving mechanism 41, the paddle mechanism 42, the assist arm 43, and the roller member 44 positioned in front of the standby tray 40, as is the case with the first embodiment. However, the second embodiment differs from the first embodiment in that the former comprises an arm driving mechanism 80.

Figure 20:
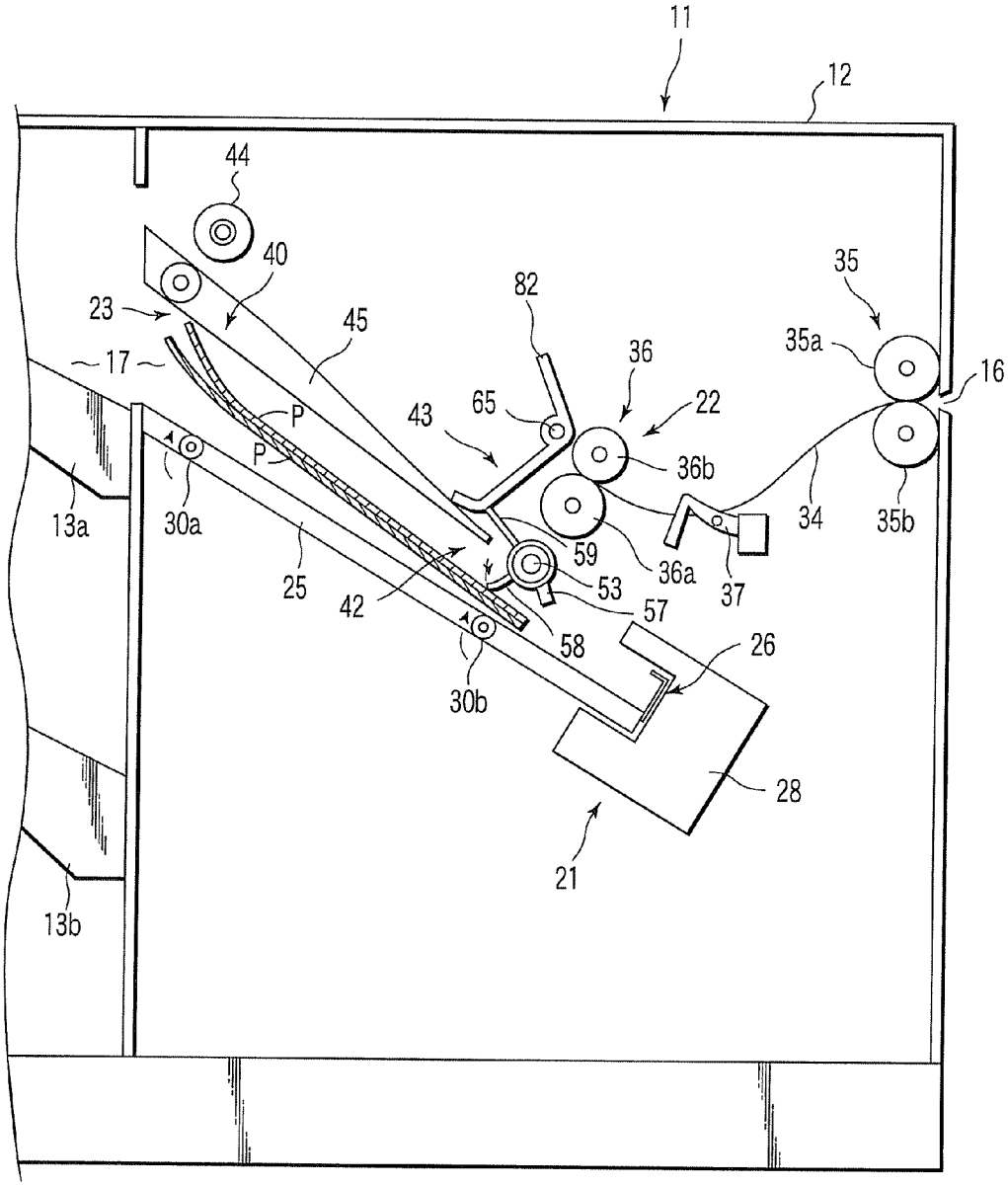
FIG. 20 is a sectional view showing that sheets are dropped from the standby tray onto a processing tray in the printed sheets processing apparatus shown in FIG. 11.

The roller member 44 is used to discharge sheets P to the discharge port 17 without post-processing them. The roller member 44 can be rotationally driven by a rotating mechanism (not shown) and moved in the vertical direction by an elevating and lowering mechanism. That is, the roller member 44 is elevated by the elevating and lowering mechanism when a sheet P is fed from the outlet roller pair 36 onto the standby tray 40 (FIG. 16) or when a sheet P is dropped from the standby tray 40 onto the processing tray 25 (FIG. 20). To discharge a sheet P that need not be post-processed from the standby tray 40 directly to the discharge port 17, the rotating mechanism rotates the roller member 44. Rotation of the roller member 44 conveys the sheets P from the standby tray 40 to the discharge port 17.

The standby tray 40 has the pair of tray members 45 into which the tray 40 has been divided in the width direction (width direction of sheets P). The tray members 45 are arranged away from and opposite each other above the processing tray 25. The tray members 45 move in synchronism with each other in the opposite directions in the width direction of the processing tray 25.

The tray driving mechanism 41 shown in FIG. 12 has a configuration and functions similar to those of the tray driving mechanism 41 described in the first embodiment. The tray driving mechanism 41 enables the pair of tray members 45 to move between the first (closed) position and the second (open) position. The paddle mechanism 42 shown in FIGS. 12 and 15 has a configuration and functions similar to those of the paddle mechanism 42 described in the first embodiment. As shown in FIG. 12, the rear end of a sheet P sits on the sheet receiving member 57. The sheet P is, for example, A4-sized and has the pair of parallel long sides S1 and the pair of short sides S2 perpendicular to the long sides S1.

Figure 21:
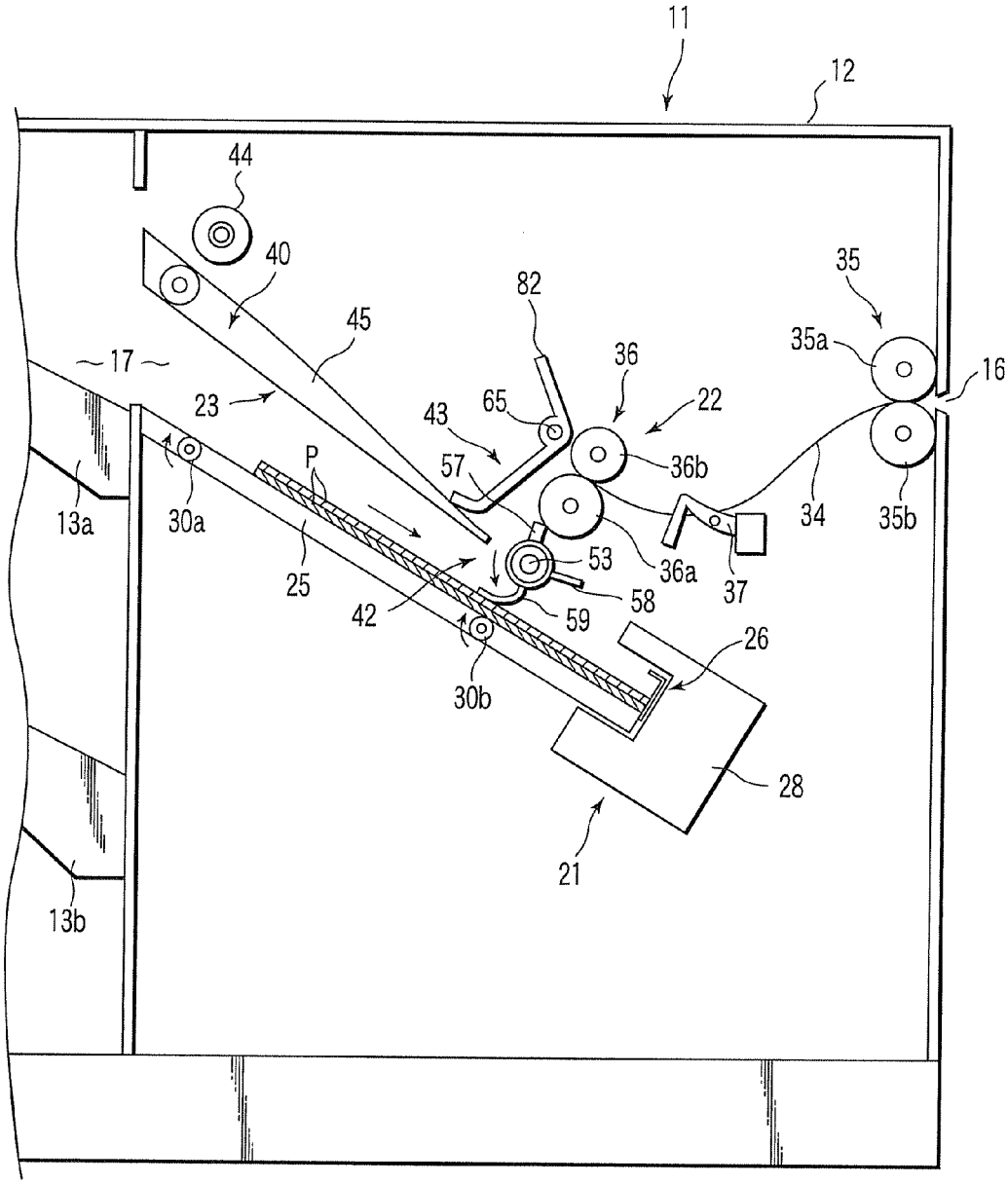
FIG. 21 is a sectional view showing that the sheets have been fed on the processing tray in the printed sheets processing apparatus shown in FIG. 11.

As the tray members 45 of the standby tray 40 move from the first position to the second position, the short paddle 58 rotates around the first shaft (paddle shaft) 53 to strike the rear ends of sheets P downward as shown in FIG. 20. The long paddle 59 has a function for rubbing the sheets P on the processing tray 25 toward the stapler 28 as shown in FIG. 21.

As shown in FIGS. 11, 12, and 15, for example, four assist arms 43 are arranged on the second arm (arm shaft) 65 in its axial direction. The second shaft 65 is rotatably supported by a lateral pair of bearing members 81 (FIG. 11). The four assist arms 43 are composed of a pair of first arm elements 43*a* and a pair of second arm elements 43*b*. The second arm elements 43*b* are located outside the first arm elements 43*a* with respect to the axial direction of the second shaft (arm shaft) 65.

When a sheet P is placed on the standby tray 40 so that the short sides S2 of the paper P extend along the axis of the first shaft 53, the first arm elements 43*a* correspond to the opposite ends of the short sides S2 of the sheet P. When the sheet P is placed on the standby tray 40 so that the long side S1 of the paper P extend along the axis of the first shaft 53, the second arm elements 43*b* correspond to the opposite ends of the long side S1 of the sheet P.

Figure 13:
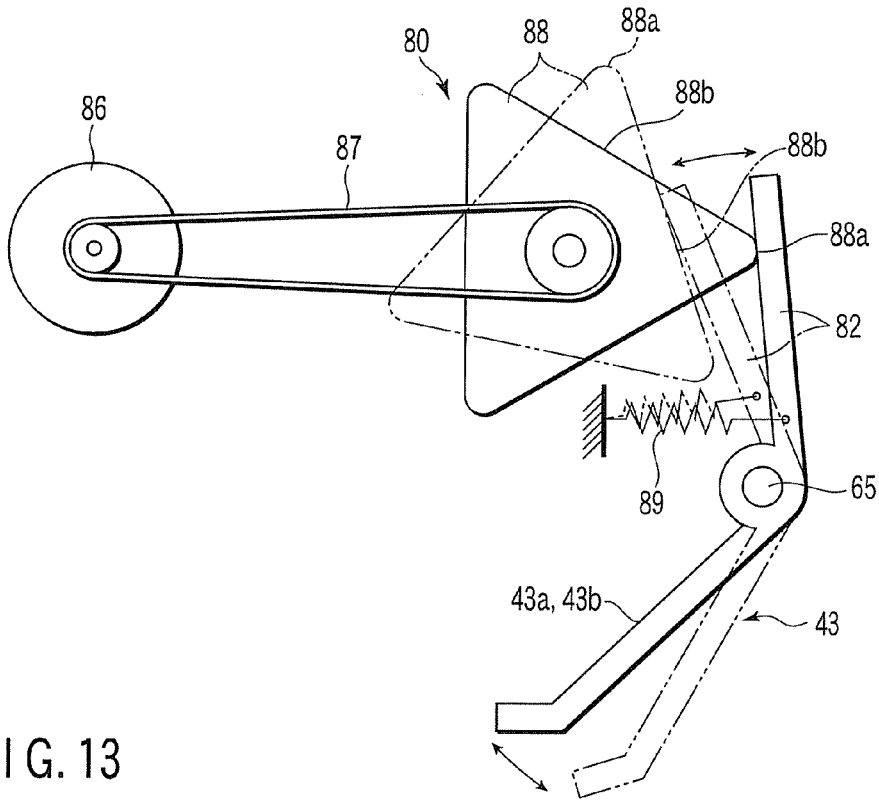
FIG. 13 is a side view showing an assist arm and an arm driving mechanism in the printed sheet processing apparatus shown in FIG. 11.
Figure 16:
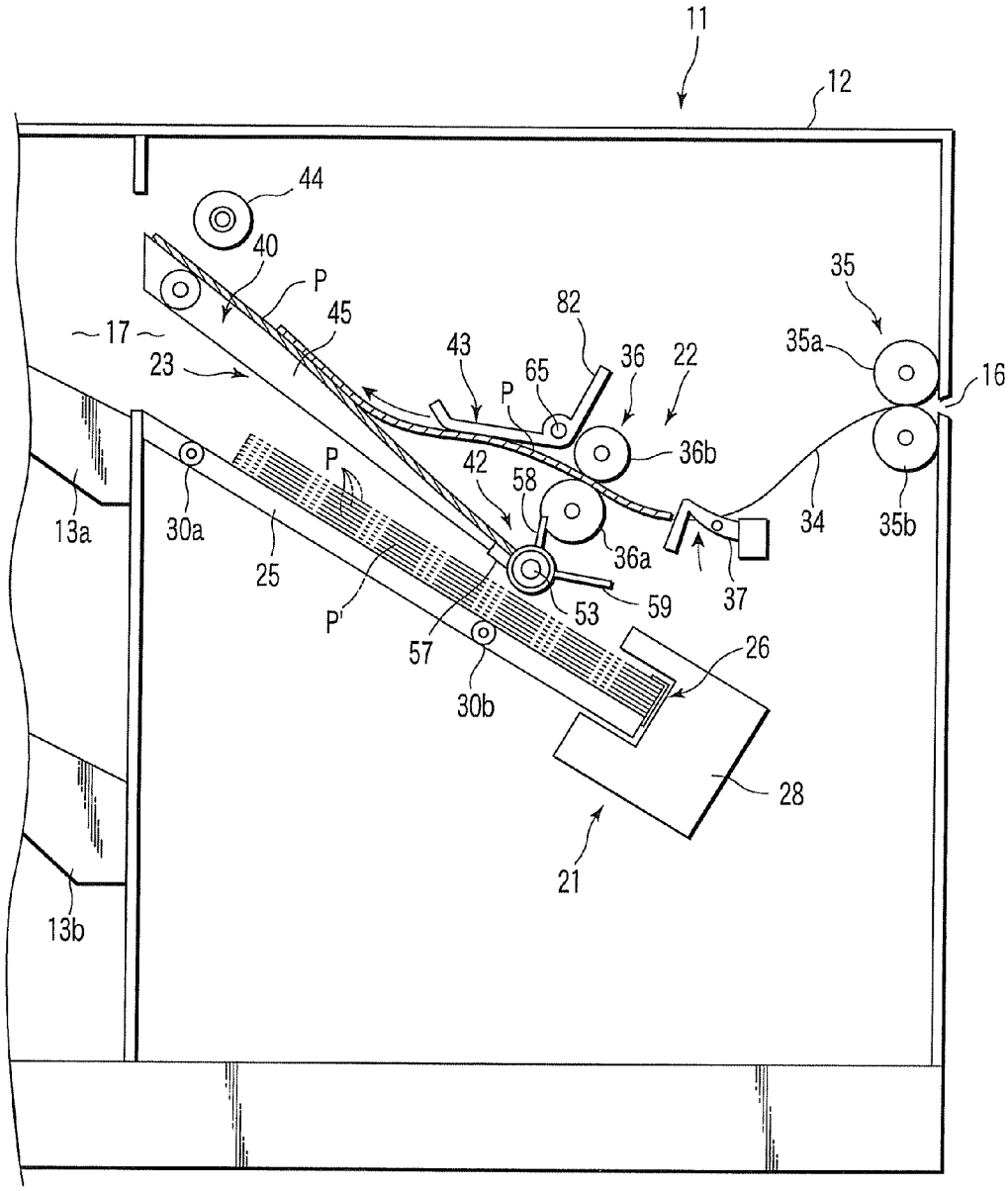
FIG. 16 is a sectional view showing that the rear end of the second sheet has passed by a sensor in the printed sheets processing apparatus shown in FIG. 11.
Figure 17:
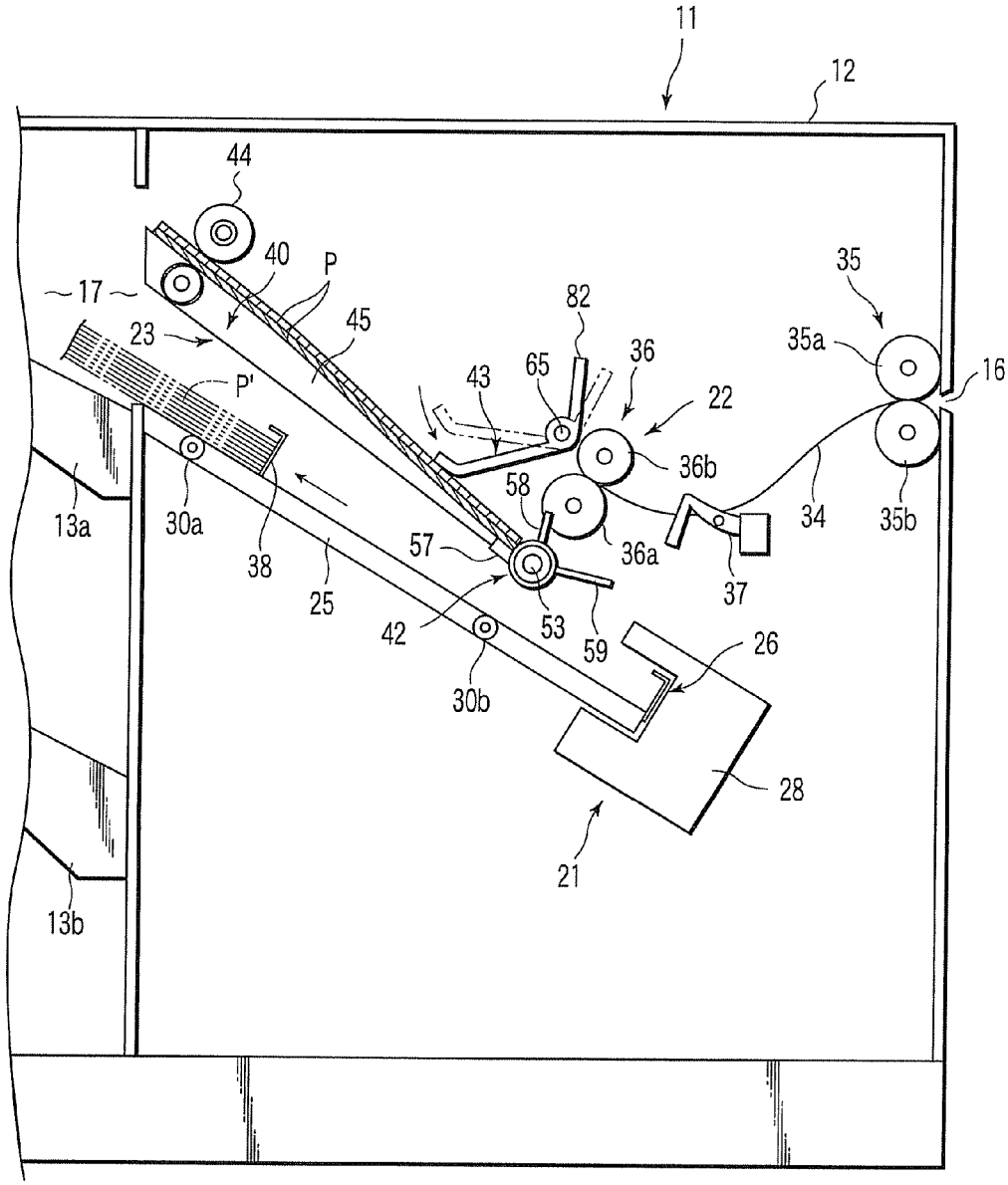
FIG. 17 is a sectional view showing that the second sheet has been supplied to the standby tray in the printed sheets processing apparatus shown in FIG. 11.

As shown in FIG. 13, each of the assist arms 43 has a receiving portion 82 that receives a driving force transmitted by the arm driving mechanism 80. As shown in FIGS. 15 to 17, the tip of the assist arm 43 hangs obliquely forward toward the processing tray 25.

The arm driving mechanism 80 is located so as to transmit power to, for example, the left second arm element 43*b*, shown in FIG. 11. In this figure, the arm driving mechanism 80 is omitted. The arm driving mechanism 80 comprises a stepping motor 86, a belt member 87 that transmits the driving force of the stepping motor 86, a cam 88 that transmits the driving force of the belt member 87 to the assist arm 43, and a return spring 89 that urges the assist arm 43 toward the cam 88. The cam 88 is triangular with rounded corners.

As shown by solid lines in FIG. 13, the stepping motor 86 is driven to abut the receiving portion 82 of the assist arm 43 against a corner 88*a* of the cam 88. The assist arm 43 then rises around the second shaft 65. The rising assist arm 43 allows the assist arm 43 to guide the sheet P to the standby tray 40.

The stepping motor 86 rotates by several steps to rotate the cam 88. Then, as shown by two-dot chain line in FIG. 13, the receiving portion 82 urged by the return spring 89 abuts against a side portion 88*b* of the cam 88. This lowers the assist arm 43 around the second shaft 65. The lowered assist arm 43 inhibits the sheets P on the standby tray 40 from being warped or curled. The assist arm 43 further presses the rear ends of the sheets P toward the processing tray 25 when the tray member 45 moves from the first (closed) position to the second (open) position.

In the present embodiment, the four arm elements 43*a* and 43*b*, constituting the assist arm 43, are fixed to the second shaft (arm shaft) 65. These arm elements are elevated and lowered in synchronism by the single arm driving mechanism 80. However, the arm elements 43*a* and 43*b* may be provided with respective driving mechanisms so as to be individually driven. The assist arm 43 need not necessarily be driven by the stepping motor 86 but may be driven by another actuator such as a DC motor or a solenoid.

Figure 14:
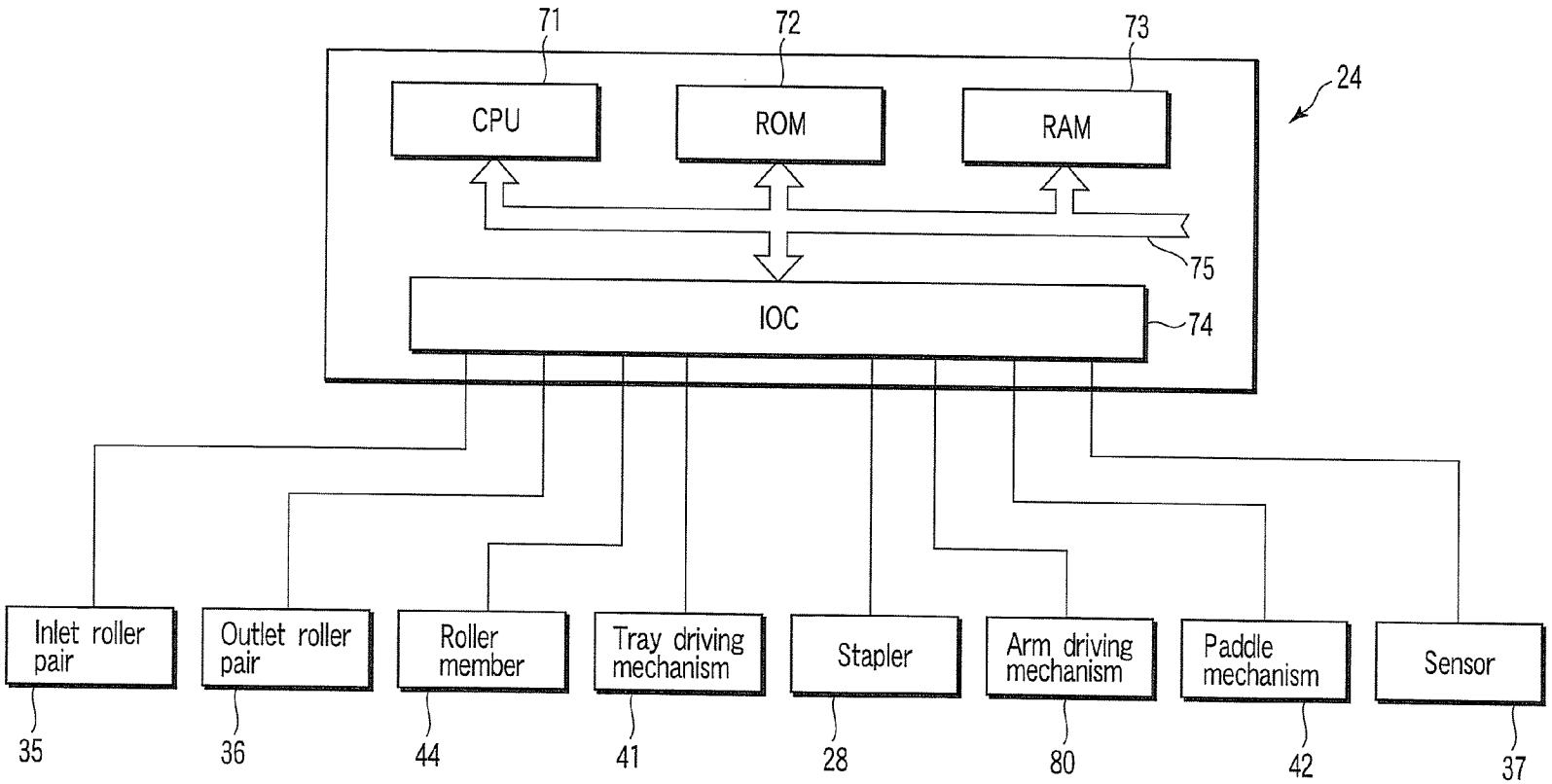
FIG. 14 is a block diagram showing control section of the printed sheet processing apparatus shown in FIG. 11.

The control section 24 shown in FIG. 14 comprises a CPU 71, ROM 72, RAM 73, input-output controller (IOC) 74, and the internal bus 75 that connects these components together. The IOC 74 is connected to, for example, the inlet roller pair 35, outlet roller pair 36, tray driving mechanism 41, roller member 44, stapler 28, arm driving mechanism 80, paddle mechanism 42, and sensor 37 via a plurality of drivers (not shown). The following information is input to the control section 24: positional information on the rear end of a sheet P detected by the sensor 37 and the like, and the size and number of sheets P from the digital copier 100, the image forming apparatus.

The control section 24 controls the arm driving mechanism 80 to enable the vertical angle of and timing for the assist arm 43 and the like to be variably set. This enables the assist arm 43 to be elevated and lowered under optimum conditions depending on the sheet type (thickness or size).

With reference to FIGS. 15 to 21, description will be given of operation of the printed sheet processing apparatus 11 according to the second embodiment configured as described above.

FIG. 15 shows that the first sheet P sits on the standby tray 40, while the second sheet P is being supplied to the standby tray 40. The second sheet P moves on the conveying path 34 toward the outlet roller pair 36, while actuating the sensor 37, located in the middle of the conveying path 34. The assist arm 43 is in its elevated position to guide the sheet P to the standby tray 40. On this occasion, the tray members 45 of the standby tray 40 are in the first (closed) position to allow sheets P to be placed on the standby tray 40.

As shown in FIG. 12, the lateral pair of tray members 45 supports the opposite ends of a sheet P in its width direction. The sheet receiving member 57 of the paddle mechanism 42 supports the vicinity of widthwise center of rear end of the sheet P. As shown in FIG. 15, a predetermined number of sheets P already fed on the processing tray 25 are aligned with one another in the width direction and longitudinal direction by the aligning mechanism 26. A pile of sheets P' is thus formed.

As shown in FIG. 16, the second sheet P is fed from the outlet roller pair 36 onto the standby array 40 while being guided by the assist arm 43. When the rear end of the sheet P passes by the sensor 37, the sensor 37 sends a signal indicating that the rear end of the sheet P has passed by, to the control section 24. A staple process is executed on the pile of sheets P' of sheets on the processing tray 25, which have been aligned together by the aligning mechanism 26.

As shown in FIG. 17, when the two sheets P are stacked on the standby tray 40, the arm driving mechanism 80 lowers the assist arm 43 to the sheets P on the standby tray 40. The lowering of the assist arm 43 is carried out by actuating the arm driving mechanism 80 a predetermined time after the control section 24 has received the signal for the rear end of the sheet P. The assist arm 43 inhibits the rear of the sheets P from being curled or warped regardless of the type (thickness or size) of the sheets P or the print pattern. While the two sheets P are being stacked on the standby tray 40, the preceding pile of sheets P' is conveyed to the sheet discharging tray 13*a*, located above, by the discharging mechanism 38.

Figure 18:
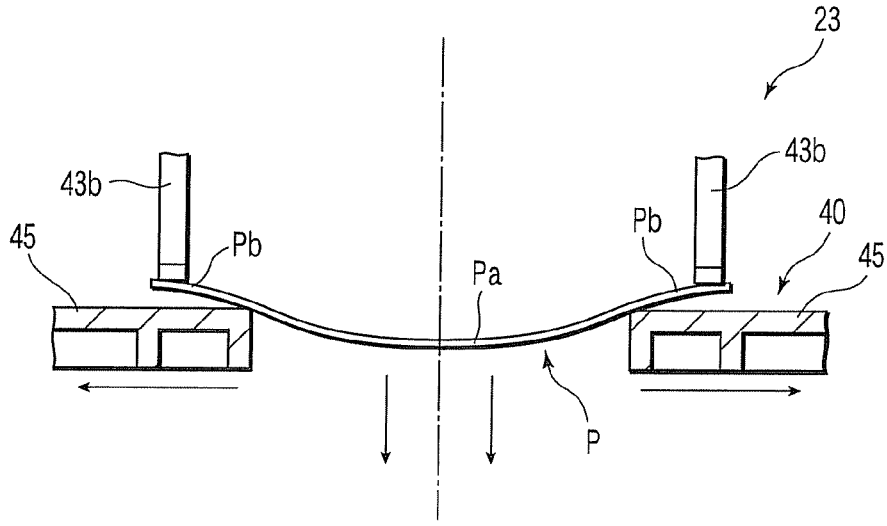
FIG. 18 is a sectional view showing that the standby tray is being opened in the printed sheets processing apparatus shown in FIG. 11.
Figure 19:
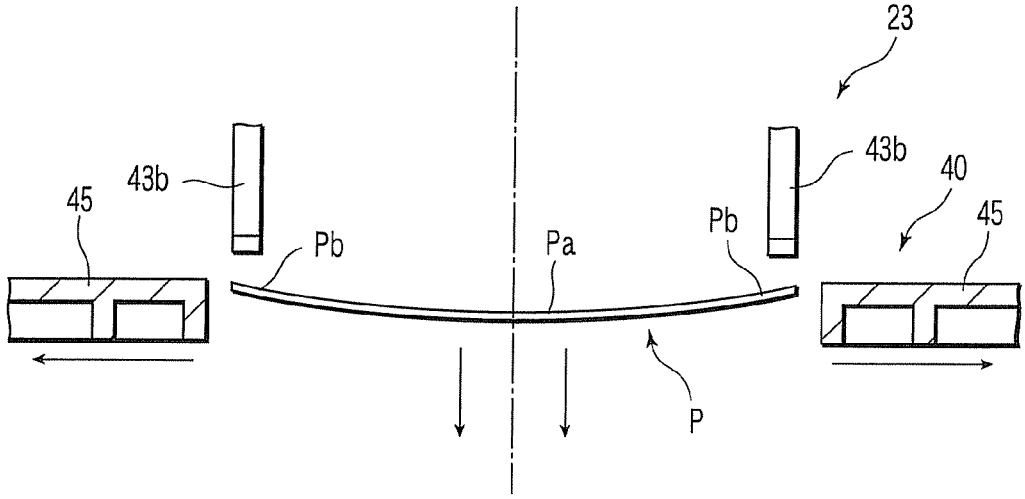
FIG. 19 is a sectional view showing that the standby tray shown in FIG. 18 is fully open.

The tray driving mechanism 41 is actuated to move the tray members 45 of the standby tray 40 from the first (closed) position to the second (open) position. As shown in FIG. 18, while the tray members 45 are between the first (closed) position and second (open) position, the sheets P are warped between the paired tray members 45 so as be lower in their central portion Pa and higher at their opposite ends Pb in the width direction. At this time, the lowered second arm elements 43*b* are pressing the sheets P toward the processing tray 25. As shown in FIG. 19, when the tray members 45 completely arrive at the second (open) position, the weight of the sheets P and the lowered second arm elements 43*b* push the sheet P toward the processing tray 25.

As the tray members 45 move from the first (closed) position to the second (open) position, the paddle mechanism 42 rotates. That is, as shown in FIG. 20, the sheet receiving member 57 rotates around the first shaft 53 to stop supporting the rear ends of the sheets P. The short paddle 58 and long paddle 59 also rotate in the same direction.

Thus, the two sheets P fall from between the paired tray members 45 onto the processing tray 25 owing to their weight and the action of the second arm elements 43*b*. At the same time, the short paddle 58 strikes the top surface of the sheets P to help drop them. The two sheets P are thus forcibly dropped onto the processing tray 25. When the sheets P fall from the standby tray 40, the assist arm 43 inhibits the situation in which sheets P floating from the standby tray 40 and cannot be dropped. This enables the sheets P to fall stably toward the processing tray 25.

In the above description, the sheets P are placed on the tray members 45 so that their long sides S1 extend along the second shaft (arm shaft) 65. In FIGS. 18 and 19, the first arm elements 43*a* are omitted. If the sheets P are placed on the tray members 45 so that their short sides S2 extend along the second shaft 65, the first arm elements 43*a* press the opposite ends of the short sides S2 of the sheets P to push the sheets P toward the processing tray 25.

As shown in FIG. 21, the sheets P having fallen onto the processing tray 25 are fed toward the stapler 28. The processing tray 25 is inclined so that its rear end (side closer to the stapler 28) is lower. Consequently, the sheets P having fallen onto the processing tray 25 have their rear ends slipped down toward the stapler 28. The lower sheet P on the processing tray 25 is conveyed toward the stapler 28 by rotation of the conveying rollers 30*a* and 30*b*. The upper sheet P on the processing tray 25 is urged to move toward the stapler 28 by a scraping operation of long paddle 59 of the paddle mechanism 59.

The two sheets P sit on the processing tray 25 as previously described. Subsequently, with the standby tray 40 kept in the second (closed) position, succeeding sheets P are sequentially fed from the outlet roller pair 36 to the processing tray 25. That is, the sheets P exiting the outlet roller pair 36 are guided to the processing tray 25 without sitting on the standby tray 40. These sheets P are sequentially stacked on the sheets P already placed on the processing tray 25. The aligning mechanism 26 also aligns the sheets P in the width direction and longitudinal direction to form a pile of sheets P' (FIG. 15).

As shown in FIG. 14, after a bundle P' of a predetermined number of sheets P is formed on the processing tray 25, the stapler 28 executes a staple process as required. The pile of sheets P' is discharged through the discharge port 17 to the sheet discharging tray 13*a*, located above, by the discharging mechanism 38 as shown in FIG. 17.

As described above, while a post-process (for example, a staple process) is being executed on the pile of sheets P' on the processing tray 25, the two succeeding sheets P can be kept on the standby tray 40. That is, the arrival of the sheets P at the processing tray 25 can be delayed. This ensures the time required to post-process the pile of sheets P', enabling the post-process to be completed without any problems.

If the arrival of the sheets P at the processing tray 25 need not be delayed as in the case where the staple process is not executed, the standby tray 40 is set in the second (open) position when the first sheet P exits the outlet roller pair 36. This allows a sheet P exiting the outlet roller pair 36 to fall immediately onto the processing tray 25.

According to the printed sheet processing apparatus 11 of the second embodiment described above, the standby tray 40 enables a reduction in the length of the conveying path for sheets P. The size of the printed sheet processing apparatus 11 can thus be reduced. Moreover, the assist arm 43 ensures the safety of the sheets P on the standby tray 40.

That is, the assist arm 43 can inhibit the sheets P on the standby tray 40 from being warped or curled depending on the type (size or thickness) of sheets P or the print pattern. This allows the sheets P to be appropriately placed on the standby tray 25. Further, when the sheets P are dropped from the standby tray 40 onto the processing tray 25, the assist arm 43 prevents the sheets P from remaining on the standby tray 40. The sheets P can thus be reliably dropped.

The assist arms 43 also provide a guide function for guiding the sheets P fed from the outlet roller pair 36 onto the standby tray 40, to the standby tray 40. This advantageously eliminates dedicated guide mechanisms to reduce the number of parts required.

Figure 22:
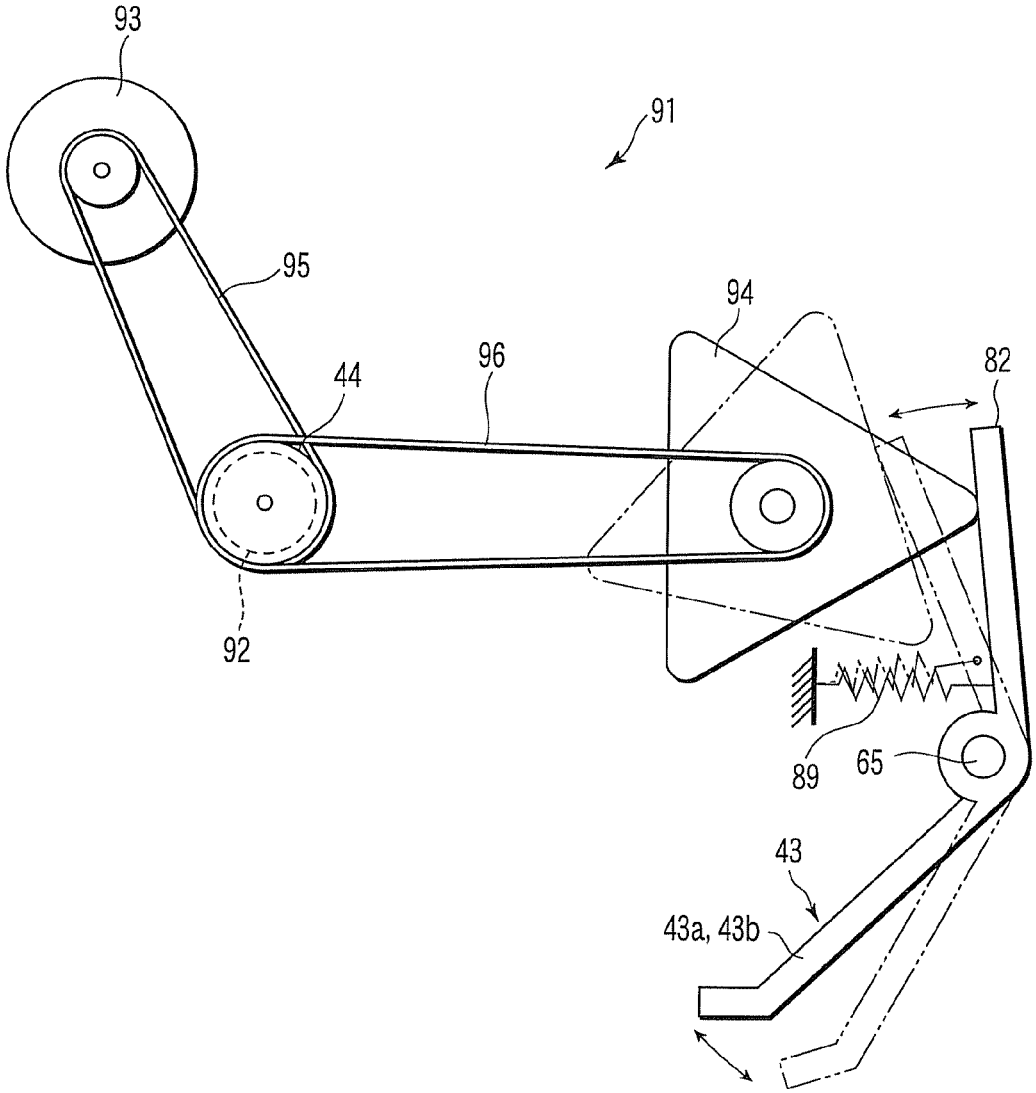
FIG. 22 is a side view showing an assist arm and an arm driving mechanism in a printed sheet processing apparatus according to a third embodiment of the present invention.

Now, with reference to FIG. 22, description will be given of a third embodiment of the printed sheet processing apparatus 11. The configuration of printed sheet processing apparatus 11 of the third embodiment is the same as that of printed sheet processing apparatus 11 of the second embodiment except for an arm driving mechanism 91. Accordingly, the other components are denoted by reference numerals common to the second embodiment and will not be described.

The arm driving mechanism 91 of printed sheet processing apparatus 11 of the third embodiment also acts as a driving source for the roller member 44. The roller member 44 has a discharging function for discharging sheets that are not formed into a pile of sheets, from the standby tray 40 to the outside of the apparatus 11. The arm driving mechanism 91 comprises a stepping motor 93, a cam 94, a first belt member 95, and a second belt member 96. The first belt member 95 transmits the driving force of the stepping motor 93 to the roller member 44. The second belt member 96 transmits the driving force transmitted to the roller member 44, to the cam 94.

The roller member 44 contains a one-way clutch 92. Rotating the stepping motor 93 in the first direction rotates the first belt member 95, which in turn rotates the roller member 44 in the direction in which a sheet P is fed. In this case, the one-way clutch 92 is actuated and the second belt member 96 remains stopped. Thus, rotating the stepping motor 93 in the first direction enables only the roller member 44 to be rotated.

Rotating the stepping motor 93 in a second (reverse) direction reverses the roller member 44 to rotate the second belt member 96. The driving force of the stepping motor 93 is transmitted to the assist arm 43. This enables the assist arm 43 to rotate. Before being reversed, the roller member 44 is elevated by the elevating and lowering mechanism.

The printed sheet processing apparatus 11 of the third embodiment can utilize the rotation of the stepping motor 93 in the first and second directions to drive each of the roller member 44 and assist arm 43. The belt members 95 and 96 and one-way clutch 92 of the arm driving mechanism 91 function as power transmitting section for rotating the roller member 44. This eliminates separate driving sources for the roller member 44 and assist arm 43, thus enabling a reduction in the number of parts required.

The rear ends of the sheets P placed on the standby tray 40 can be pressed by the assist arm 43. This makes it possible to prevent the rear ends of the sheets from floating from the standby tray 40 to vary their positions. While the tray members 45 are between the first position and second position, the sheets are supported by the tray members so as to be warped in such a way that they are lower in their widthwise central portion. Under these conditions, the assist arms 43 corresponding to the widthwise opposite ends of the sheets push the opposite ends toward the processing tray 25. This prevents the sheets with their opposite ends flowing from remaining on the tray members 45. The sheets can be reliably dropped onto the processing tray.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for processing printed sheets connected to an image forming apparatus, the apparatus for processing printed sheets comprising:

a processing tray on which the sheets are aligned with one another in a width direction and a longitudinal direction to form a pile of sheets;

a standby tray having a pair of tray members arranged away from each other in the width direction above the processing tray, the tray members being movable in the width direction, the tray members moving between a first position at which a sheet is placed on the tray members and a second position at which the sheet on the tray members is dropped onto the processing tray;

a tray driving mechanism which moves the pair of tray members between the first and second positions in synchronism with each other, a roller mechanism placed near a rear end of the standby tray to feed the sheets from the image forming apparatus onto the standby tray;

an assist arm which is movable in a vertical direction around an arm shaft placed near the roller mechanism, the assist arm rising in contact with the sheet being fed from the roller mechanism onto the standby tray, lowering when the sheet has been fed onto the standby tray, and pressing a rear end of the sheet toward the processing tray when the tray members move from the first position to the second position;

a stapler placed behind the processing tray to staple the pile of sheets; and a paddle mechanism placed near the rear end of the standby tray, the paddle mechanism has a paddle member which rotates around a shaft, and the paddle member strikes the rear end of the sheet when the pair of tray members of the standby tray moves from the first position to the second position, the paddle member having:

a short paddle which strikes the rear end of the sheet downward as the pair of tray members of the standby tray moves from the first position to the second position; and a long paddle which rubs the sheet on the processing tray toward the stapler.

2. The apparatus for processing printed sheets according to claim 1, wherein the assist arm has a tip which contacts the sheet, and the tip of the assist arm hangs down obliquely toward the standby tray.

3. The apparatus for processing printed sheets according to claim 1, wherein the shaft of the paddle mechanism is provided with a sheet receiving member configured to allow the rear end of the sheet to be placed on the sheet receiving member.

4. The apparatus for processing printed sheets according to claim 1, wherein the paddle member is placed between the processing tray and the roller mechanism.

5. The apparatus for processing printed sheets according to claim 1, wherein the roller mechanism comprises a conveying roller that is rotationally driven and a pinch roller provided above and opposite the conveying roller, and the arm shaft of the assist arm is placed near a rotating center of the pinch roller.

6. The apparatus for processing printed sheets according to claim 1, wherein the assist arm also serves as a guide member which guides the sheet fed from the roller mechanism onto the standby tray, along a top surface of the standby tray toward a front of the standby tray.

7. The apparatus for processing printed sheets according to claim 1, further comprising an arm driving mechanism which carries out the elevation and lowering of the assist arm.

8. The apparatus for processing printed sheets according to claim 7, further comprising a sensor located upstream of the roller mechanism to detect the rear end of the sheet, wherein the arm driving mechanism lowers the assist arm a predetermined time after the sensor has detected the rear end of the sheet.

9. The apparatus for processing printed sheets according to claim 7, further comprising a roller member which discharges a sheet which is not formed into the pile of sheets, from the standby tray to an outside of the apparatus, wherein the arm driving mechanism has power transmitting section for rotating the roller member.

10. The apparatus for processing printed sheets according to claim 7, wherein the assist arm has:

a pair of inner arm elements which press the sheet toward the processing tray with the sheet placed on the standby tray so that short sides of the sheet extend along the arm shaft; and a pair of outer arm elements which press the sheet toward the processing tray with the sheet placed on the standby tray so that long sides of the sheets extend along the arm shaft.

11. A method for processing printed sheets, the method comprising:

rotating a roller mechanism to feed a sheet from an image forming apparatus onto a standby tray having a pair of tray members;

elevating an assist arm when the sheet is fed onto the standby tray by the roller mechanism, to allow the sheet to pass below the assist arm onto the standby tray;

moving the pair of tray members of the standby tray in a direction in which the tray members are separated from each other, to drop the sheet placed on the standby tray, onto the processing tray;

lowering the assist arm when the sheet falls from the standby tray onto the processing tray, and pressing a rear end of the sheet toward the processing tray;

striking the rear end of the sheet downward by a short paddle when the sheet is dropped onto the processing tray from the standby tray;

rubbing the sheet dropped onto the processing tray by a long paddle towards a stapler which is placed behind the processing tray; and aligning the sheets with one another in a width direction and a longitudinal direction to form a pile of sheets.

12. The method for processing printed sheets according to claim 11, wherein the assist arm lowers to the sheet on the standby tray owing to the weight of the assist arm.

13. The method for processing printed sheets according to claim 11, wherein the assist arm is lowered by an arm driving mechanism a predetermined time after a sensor which is provided upstream of the roller mechanism has detected the rear end of the sheet.

* * * * *